US011879233B2

(12) United States Patent
Narikawa et al.

(10) Patent No.: US 11,879,233 B2
(45) Date of Patent: Jan. 23, 2024

(54) WORK MACHINE

(71) Applicant: HITACHI CONSTRUCTION MACHINERY CO., LTD., Tokyo (JP)

(72) Inventors: Ryu Narikawa, Tokyo (JP); Hiroshi Sakamoto, Tsuchiura (JP); Hidekazu Moriki, Tokyo (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 688 days.

(21) Appl. No.: 17/054,797

(22) PCT Filed: Jun. 7, 2019

(86) PCT No.: PCT/JP2019/022688
§ 371 (c)(1),
(2) Date: Nov. 12, 2020

(87) PCT Pub. No.: WO2020/054154
PCT Pub. Date: Mar. 19, 2020

(65) Prior Publication Data

US 2021/0230837 A1 Jul. 29, 2021

(30) Foreign Application Priority Data

Sep. 14, 2018 (JP) ..... 2018-171991

(51) Int. Cl.
*E02F 9/24* (2006.01)
*E02F 3/32* (2006.01)
(Continued)

(52) U.S. Cl.
CPC ..... *E02F 9/2033* (2013.01); *E02F 9/2271* (2013.01); *E02F 9/24* (2013.01);
(Continued)

(58) Field of Classification Search
CPC . E02F 3/32; E02F 3/435; E02F 9/2033; E02F 9/2221; E02F 9/2228; E02F 9/2271;
(Continued)

(56) References Cited

U.S. PATENT DOCUMENTS 5,490,081 A 2/1996 Kuromoto et al.
5,704,142 A 1/1998 Stump
2008/0133128 A1 6/2008 Koch

FOREIGN PATENT DOCUMENTS

CN 106502137 A 3/2017
JP 05-321290 A 12/1993
(Continued)

OTHER PUBLICATIONS

International Preliminary Report on Patentability received in corresponding International Application No. PCT/JP2019/022688 dated Mar. 25, 2021.
(Continued)

*Primary Examiner* — Charles J Han
(74) *Attorney, Agent, or Firm* — Mattingly & Malur, PC

(57) ABSTRACT

A work machine includes a plurality of actuators that drive a work device; a posture sensor that senses postural data about the work device; and a controller having a degree-of-proximity calculating section that computes a degree of proximity that is an index value indicating proximity between an intrusion prohibition region and the work device on the basis of positional data about the intrusion prohibition region and the postural data. A command section executes, when the proximity specified by the degree of proximity is closer than proximity specified by a degree-of-proximity threshold, operating area limiting control to decelerate at least one of the plurality of actuators such that an intrusion of the work device into the intrusion prohibition region is prevented. History of the data about the degree of proximity
(Continued)

calculated at the degree-of-proximity calculating section is stored and the degree-of-proximity threshold is altered on the basis of the history data.

3 Claims, 17 Drawing Sheets

(51) Int. Cl.

| | |
|---|---|
| ***E02F 9/20*** | (2006.01) |
| ***E02F 9/22*** | (2006.01) |
| ***E02F 9/26*** | (2006.01) |
| *E02F 3/43* | (2006.01) |

(52) U.S. Cl.
CPC ..... *E02F 9/265* (2013.01); *E02F 3/32* (2013.01); *E02F 3/435* (2013.01); *E02F 9/2221* (2013.01); *E02F 9/2285* (2013.01); *E02F 9/2292* (2013.01); *E02F 9/2296* (2013.01)

(58) Field of Classification Search
CPC ..... E02F 9/2285; E02F 9/2292; E02F 9/2296; E02F 9/24; E02F 9/2626; E02F 9/265; E02F 9/26
See application file for complete search history.

(56) References Cited

FOREIGN PATENT DOCUMENTS

| | | | |
|---|---|---|---|
| JP | 09-71965 | A | 3/1997 |
| JP | 2010-126954 | A | 6/2010 |
| JP | 2013-159930 | A | 8/2013 |
| WO | 2008/066654 | A1 | 6/2008 |

OTHER PUBLICATIONS

Extended European Search Report received in corresponding European Application No. 19861087.5 dated Feb. 2, 2022.
International Search Report of PCT/JP2019/022688 dated Sep. 3, 2019.

WORK MACHINE

TECHNICAL FIELD

The present invention relates to a work machine.

BACKGROUND ART

In a case where work such as excavation or loading is performed by using a work machine (e.g. a hydraulic excavator) including a work device (e.g. an articulated front work implement) driven by hydraulic actuators, there are electric cables and the like above the work machine if the space where the work is performed is an outdoor space, or there is a ceiling if the space is an indoor space, in some cases. An operator of the work machine needs to operate the work machine such that contact between those obstacles and the work machine is avoided.

As a technology that assists operator's operation in an environment where there are obstacles around a work machine in this manner, Patent Document 1 discloses a surrounding region monitoring device. On the basis of results of detection by an object detecting device that detects an object in a monitored region set around a work machine, and a marker image in an image captured by an image-capturing device mounted on the work machine, the surrounding region monitoring device determines whether or not the object in the monitored region is a warning limitation target object, prohibits output of a warning in a case where the object in the monitored region is the warning limitation target object, and outputs a warning in a case where the warning limitation target object has entered a predetermined region closer to the work machine in the monitored region.

In addition, Patent Document 2 discloses a work-implement operating area limiting device in which a dangerous region (in the following, also referred to as an "intrusion prohibition region") is provided in an operating area space of a work implement (front work implement), and the work-implement operating area limiting device decelerates the velocity of the work implement before the dangerous region, and stops the work implement immediately before the dangerous region.

PRIOR ART DOCUMENT

Patent Documents

Patent Document 1: JP-2013-159930-A
Patent Document 2: JP-1993-321290-A

SUMMARY OF THE INVENTION

Problem to be Solved by the Invention

According to Patent Document 1, a marker is patched onto a warning limitation target object in some cases. Further, this technique is configured such that a warning is issued when an object having the marker patched thereon is close to the proximity of the work machine compared with an object not having a marker patched thereon. However, as it is not always the case where an operator recognizes the object onto which the marker is patched, there is a possibility that the work machine gets too close to the object onto which the marker is patched.

On the other hand, Patent Document 2 adopts, as a method of decelerating a work implement in a case where it gets close to a dangerous region (intrusion prohibition region), a method in which, by comparing a work-implement velocity based on a deceleration pattern according to the distance between the work implement and the dangerous region with a work-implement velocity proportional to an amount of operation of a work-implement lever by an operator, the work implement is driven with a command value based on the lower work-implement velocity between them. That is, in a case where the work-implement velocity based on the deceleration pattern is lower than the work-implement velocity proportional to the operation amount of the work-implement lever, the work implement is always operated at the work-implement velocity based on the deceleration pattern no matter whether or not the operator recognizes the dangerous region. Accordingly, in a case where a region where a hydraulic excavator performs normal work and the dangerous region are in proximity to each other, there is a fear that control intervention based on the proximity to the dangerous region frequently occurs to deteriorate the work efficiency.

In view of this, an object of the present invention is to provide a work machine with which, while frequent control intervention is prevented to suppress the decrease of the work efficiency, an intrusion into an intrusion prohibition region can be surely prevented.

Means for Solving the Problem

The present application includes a plurality of means for solving the problem described above, and one example thereof is a work machine including: a work device installed on a machine main body; a plurality of actuators that drive the machine main body and the work device; a posture sensor that senses postural data about the machine main body and the work device; and a controller that computes a degree of proximity that is an index value indicating proximity between a preset intrusion prohibition region, and the work device and the machine main body on a basis of positional data about the intrusion prohibition region, and the postural data, and when the proximity specified by the degree of proximity is closer than proximity specified by a degree-of-proximity threshold set as a threshold for the degree of proximity, executes operating area limiting control to decelerate at least one of the plurality of actuators such that an intrusion of the work device and the machine main body into the intrusion prohibition region is prevented. The work machine further includes a storage device that stores history data about the degree of proximity computed by the controller, and the controller alters the degree-of-proximity threshold on a basis of the history data about the degree of proximity stored on the storage device.

Advantages of the Invention

According to the present invention, while the decrease of the work efficiency due to frequent control intervention is suppressed, intrusion of a hydraulic excavator into an intrusion prohibition region can be surly prevented.

MODES FOR CARRYING OUT THE INVENTION

Figure 1:
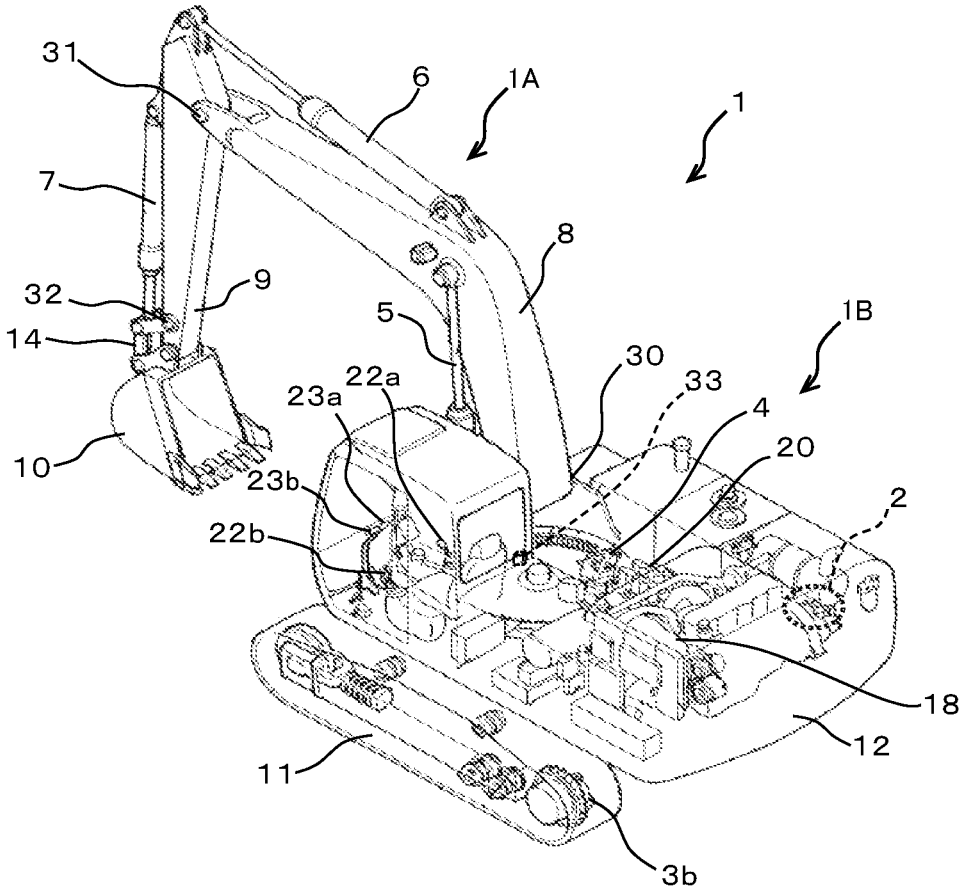
FIG. 1 is a configuration diagram of a hydraulic excavator.

In the following, embodiments of the present invention are explained by using the drawings. Note that although a hydraulic excavator including a bucket as a work device (attachment) at the tip of its work device is illustrated as a work machine in the following, the present invention may be applied to a work machine including an attachment other than a bucket. In addition, the present invention can also be applied to a work machine other than a hydraulic excavator as long as the work machine has an articulated work device including a plurality of linked members (an attachment, a boom, an arm, and the like) that are coupled with each other.

In addition, although capital letters of the alphabet are given at the ends of reference characters of a plurality of identical constituent elements in some cases in the following explanation, the plurality of constituent elements are referred to collectively without the capital letters of the alphabet in some cases. For example, when there are three identical pumps 190*a*, 190*b*, and 190*c*, these are referred to collectively as pumps 190 in some cases.

First Embodiment

Figure 2:
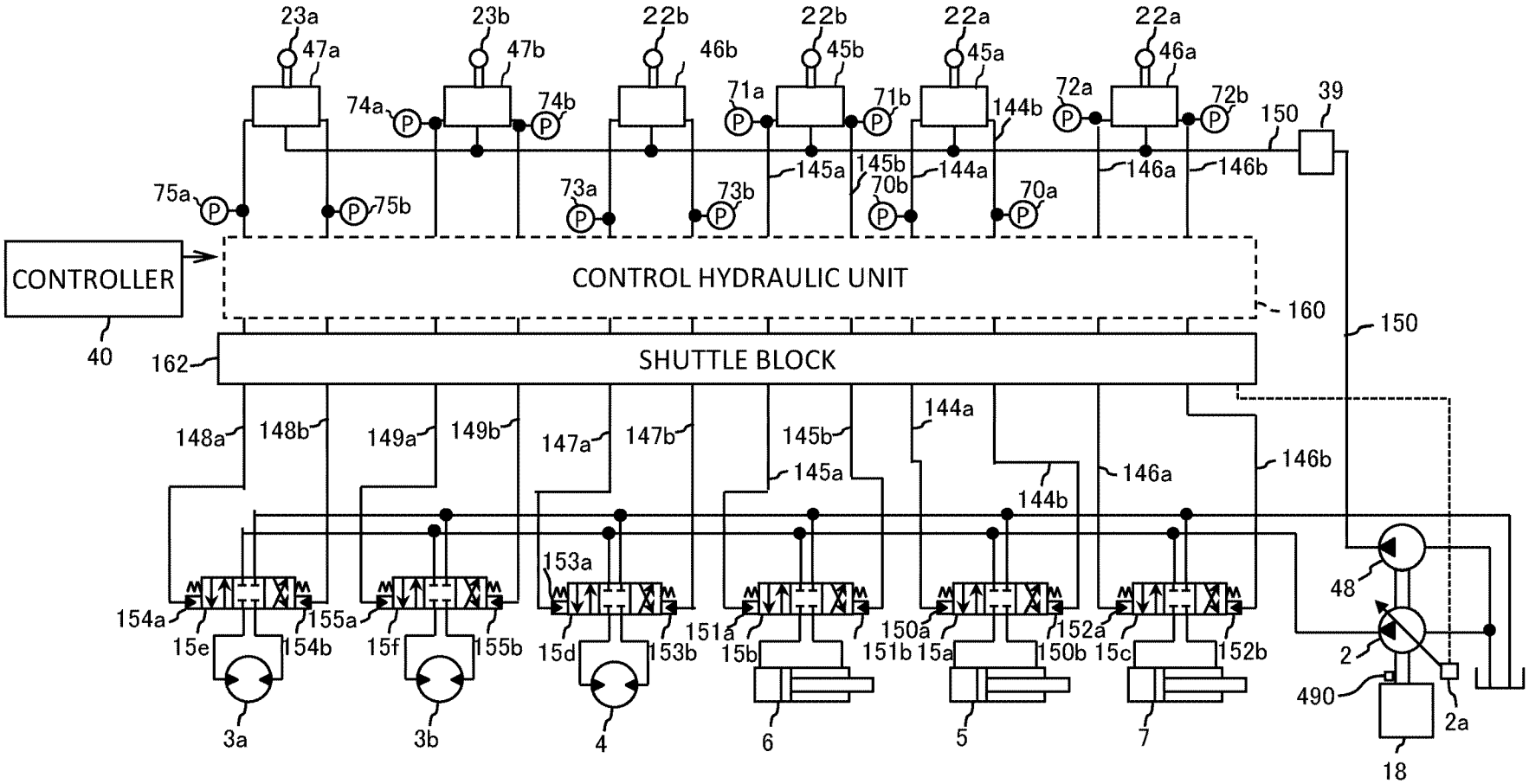
FIG. 2 is a figure illustrating a controller of the hydraulic excavator along with a hydraulic drive system.
Figure 3:
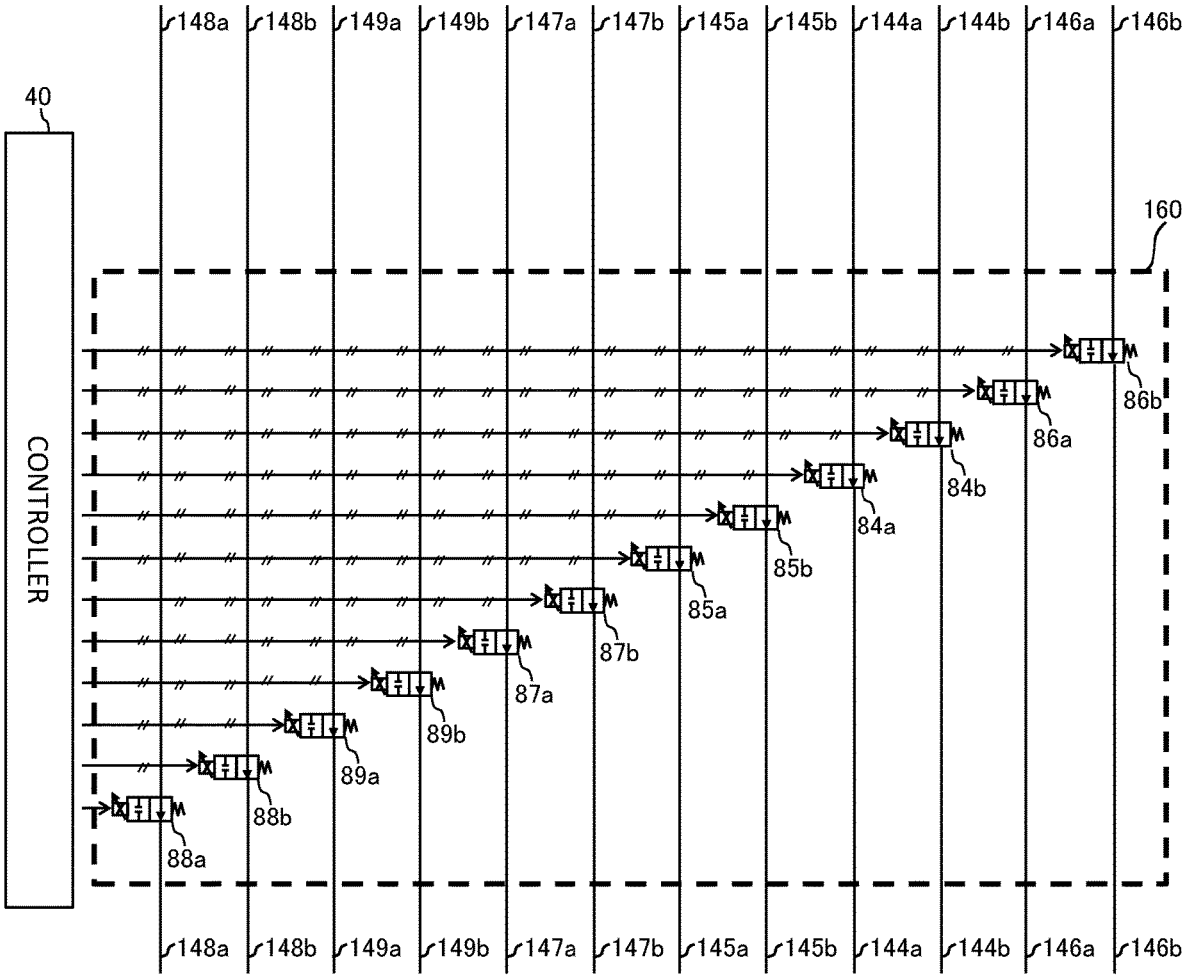
FIG. 3 is a detailed diagram of a control hydraulic unit.

FIG. 1 is a configuration diagram of a hydraulic excavator according to a first embodiment of the present invention, FIG. 2 is a figure illustrating a controller of the hydraulic excavator according to embodiments of the present invention along with a hydraulic drive system, and FIG. 3 is a detailed diagram of a front-implement-control hydraulic unit 160 illustrated in FIG. 2.

In FIG. 1, a hydraulic excavator 1 includes an articulated front work implement 1A, and a machine body (machine main body) 1B. The machine body (machine main body) 1B includes: a lower track structure 11 that is made travel by means of left and right travel hydraulic motors 3*a* and 3*b*; and an upper swing structure 12 that is attached on the lower track structure 11, and swings by means of a swing hydraulic motor 4.

The front work implement 1A includes a plurality of front-implement members (a boom 8, an arm 9 and a bucket 10) that are vertically individually pivoted, and are coupled with each other. The base end of the boom 8 is pivotably supported at a front section of the upper swing structure 12 via a boom pin. The arm 9 is pivotably coupled with the tip of the boom 8 via an arm pin, and the bucket 10 is pivotably coupled with the tip of the arm 9 via a bucket pin. The boom 8 is driven by a boom cylinder 5, the arm 9 is driven by an arm cylinder 6, and the bucket 10 is driven by a bucket cylinder 7.

In order to make it possible to measure angles of pivoting motion α, β and γ (see FIG. 5) of the boom 8, the arm 9 and the bucket 10, a boom-angle sensor 30, an arm-angle sensor 31 and a bucket-angle sensor 32 are attached to the boom pin, the arm pin and a bucket link 14, respectively, and a machine-body-inclination-angle sensor 33 that senses an angle of inclination θ (see FIG. 5) of the upper swing structure 12 (machine body 1B) relative to a reference plane (e.g. the horizontal plane) is attached to the upper swing structure 12. Note that the angle sensors 30, 31 and 32 can be replaced with angle sensors (e.g. inertial measurement units (IMUs)) that measure angles relative to a reference plane (e.g. the horizontal plane), and alternatively the angle sensors 30, 31 and 32 can be replaced with cylinder stroke sensors that sense corresponding cylinder strokes, and the obtained cylinder strokes may be converted into angles. In addition, in order to make it possible to sense the relative angle between the upper swing structure 12 and the lower track structure 11, a swing angle sensor 19, which is not illustrated, is attached near the rotation center of the upper swing structure 12 and the lower track structure 11.

An operation device 47*a* (FIG. 2) that has a travel right lever 23*a* (FIG. 1) for operating the travel right hydraulic motor 3*a* (lower track structure 11), an operation device 47*b* (FIG. 2) that has a travel left lever 23*b* (FIG. 1) for operating the travel left hydraulic motor 3*b* (lower track structure 11), operation devices 45*a* and 46*a* (FIG. 2) that share an operation right lever 22*a* (FIG. 1) for operating the boom cylinder 5 (boom 8) and the bucket cylinder 7 (bucket 10), and operation devices 45*b* and 46*b* (FIG. 2) that share an operation left lever 22*b* (FIG. 1) for operating the arm cylinder 6 (arm 9) and the swing hydraulic motor 4 (upper swing structure 12) are installed in a cab provided on the upper swing structure 12. In the following, the operation right lever 22*a*, the operation left lever 22*b*, the travel right lever 23*a* and the travel left lever 23*b* are collectively referred to as operation levers 22 and 23 in some cases.

An engine 18 as a prime mover mounted on the upper swing structure 12 drives a hydraulic pump 2 and a pilot pump 48. The hydraulic pump 2 is a variable displacement pump whose displacement is controlled by a regulator 2*a*, and the pilot pump 48 is a fixed displacement pump. In the present embodiment, as illustrated in FIG. 3, a shuttle block 162 is provided on intermediate sections of pilot lines 144, 145, 146, 147, 148, and 149. Hydraulic signals output from the operation devices 45, 46 and 47 are input also to the regulator 2*a* via the shuttle block 162. Although configuration details of the shuttle block 162 are omitted, hydraulic signals are input to the regulator 2*a* via the shuttle block 162, and the delivery flow rate of the hydraulic pump 2 is controlled according to the hydraulic signals.

A pump line 150 that is a delivery line of the pilot pump 48 passes through a lock valve 39, then branches into a plurality of lines, and is connected to each valve in the operation devices 45, 46, and 47, and the front-implement-control hydraulic unit 160. In the present example, the lock valve 39 is a solenoid selector valve, and a solenoid drive section thereof is electrically connected with a position sensor of a gate lock lever (not illustrated) arranged in the cab (FIG. 1). The position of the gate lock lever is sensed at the position sensor, and a signal according to the position of the gate lock lever is input from the position sensor to the lock valve 39. If the gate lock lever is at a lock position, the lock valve 39 is closed, and the pump line 150 is interrupted. If the gate lock lever is at an unlock position, the lock valve 39 is opened, and the pump line 150 becomes uninterrupted. That is, in a state in which the pump line 150 is interrupted, operation by the operation devices 45, 46, and 47 is disabled, and operation such as swings or excavation is prohibited.

In addition, the position sensor of the gate lock lever outputs a signal indicating positional data (position) of the gate lock lever to a controller 40 (mentioned below). In a case where the signal indicates that the gate lock lever is at the unlock position, it is indicated that the hydraulic excavator 1 is in a state in which operation of the hydraulic excavator 1 by an operator is enabled, and the operator is about to perform excavating operation with the work implement 1A, or travelling or swing operation, for example. In contrast, in a case where the signal indicates that the gate lock lever is at the lock position, it is indicated that the hydraulic excavator 1 is in a state in which operation of the hydraulic excavator 1 by an operator is disabled, and the operator is about to perform things other than work with the hydraulic excavator 1 (e.g. setting a target surface, checking a terrain profile, taking a rest, or the like).

The operation devices 45, 46, and 47 are hydraulic-pilot type operation devices, and, on the basis of a hydraulic fluid delivered from the pilot pump 48, individually generate pilot pressures (referred to as operation pressures in some cases) according to operation amounts (e.g. lever strokes) and operation directions of the operation levers 22 and 23 operated by the operator. The thus-generated pilot pressures are supplied to hydraulic drive sections 150*a* to 155*b* of corresponding flow control valves 15*a* to 15*f* (see FIG. 2) in a control valve unit 20 via pilot lines 144*a* to 149*b* (see FIG. 2), and are used as control signals to drive the flow control valves 15*a* to 15*f*.

The hydraulic fluid delivered from the hydraulic pump 2 is supplied to the travel right hydraulic motor 3*a*, the travel left hydraulic motor 3*b*, the swing hydraulic motor 4, the boom cylinder 5, the arm cylinder 6 and the bucket cylinder 7 via the flow control valves 15*a*, 15*b*, 15*c*, 15*d*, 15*e*, and 15*f* (see FIG. 2). The supplied hydraulic fluid expands or contracts the boom cylinder 5, the arm cylinder 6 and the bucket cylinder 7 to thereby pivot the boom 8, the arm 9 and the bucket 10 individually, and change the position and posture of the bucket 10. In addition, the supplied hydraulic fluid rotates the swing hydraulic motor 4 to thereby swing the upper swing structure 12 relative to the lower track structure 11. Then, the supplied hydraulic fluid rotates the travel right hydraulic motor 3*a* and the travel left hydraulic motor 3*b* to thereby makes the lower track structure 11 travel. In the following, the travel hydraulic motor 3, the swing hydraulic motor 4, the boom cylinder 5, the arm cylinder 6 and the bucket cylinder 7 are collectively referred to as hydraulic actuators 3 to 7 in some cases.

Figure 4:
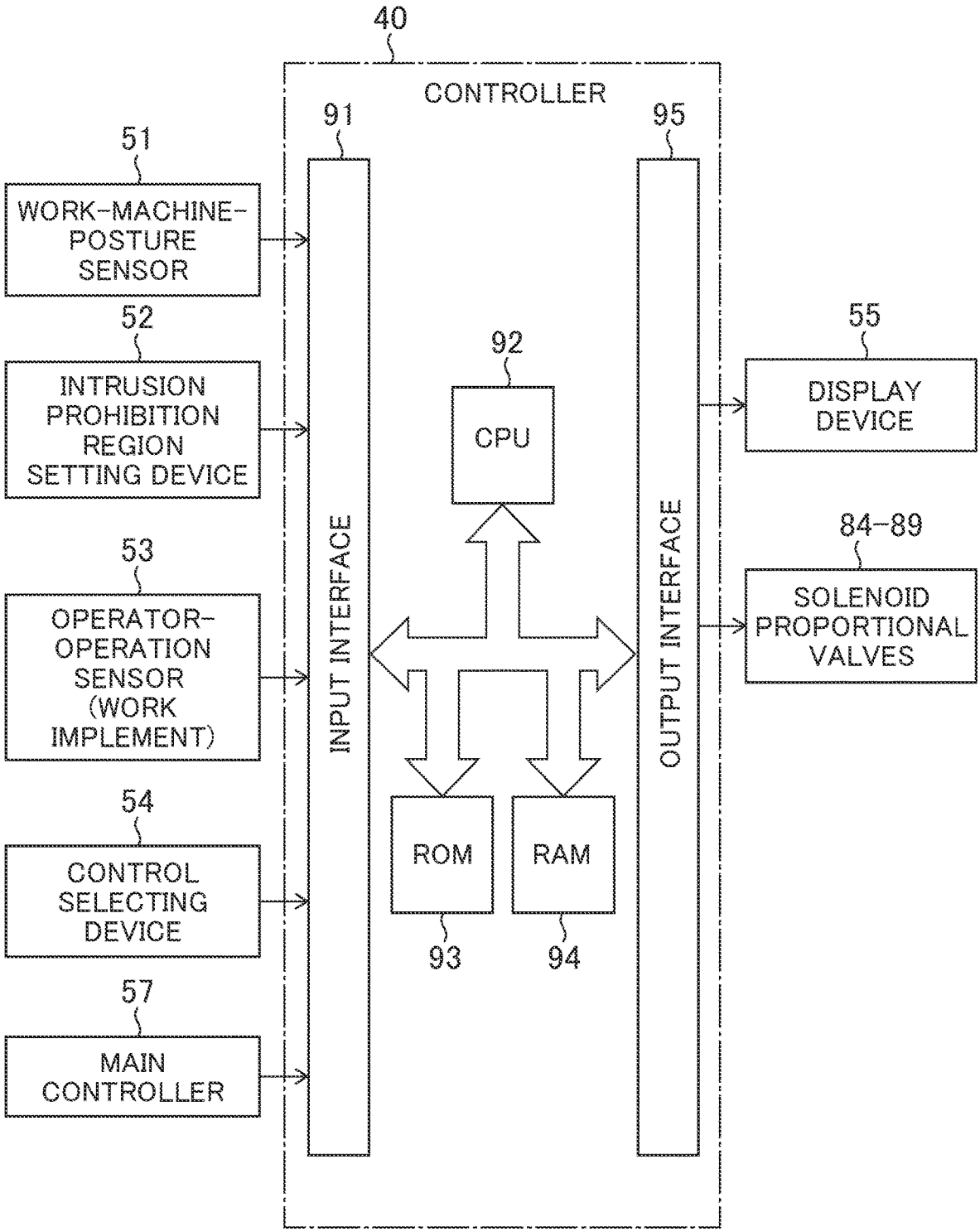
FIG. 4 is a hardware configuration diagram of the controller of the hydraulic excavator.

FIG. 4 is a configuration diagram of an operating area limiting system included in the hydraulic excavator according to the present embodiment. When the operation levers 22 and 23 are operated by an operator, the system illustrated in FIG. 4 executes operating area limiting control (deceleration control) of decelerating or stopping the hydraulic actuators 3 to 7 such that intrusions of the front work implement 1A and the machine body 1B of the hydraulic excavator into a preset intrusion prohibition region 60 (see FIG. 5) are prevented. Details of the control of the hydraulic actuators 3 to 7 by the operating area limiting system are explained.

Figure 5:
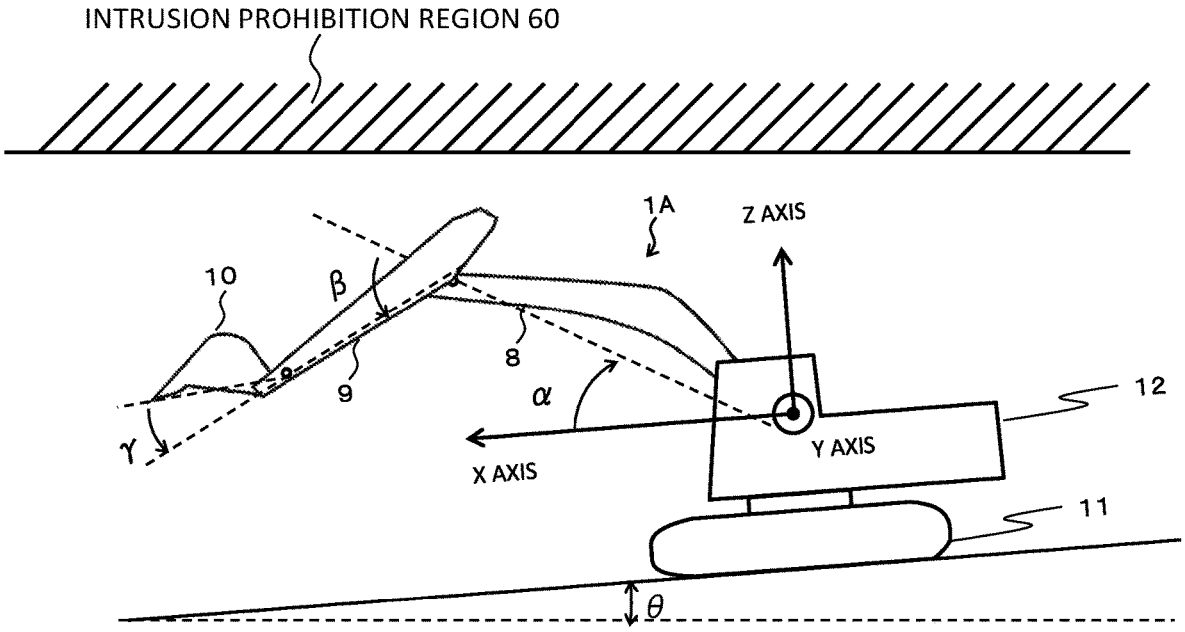
FIG. 5 is a figure illustrating a coordinate system of the hydraulic excavator.

For example, in a case where it is instructed to operate the hydraulic actuators 4 to 7 by operation of the operation lever 22, a control signal to limit operation of the hydraulic actuators 3 to 7 moving to be in proximity to the intrusion prohibition region 60 is output to corresponding ones of the flow control valves 15*a* to 15*f* on the basis of the positional relationship between the intrusion prohibition region 60 (see FIG. 5) and the point of the hydraulic excavator 1 nearest to the intrusion prohibition region 60 (a rear end section of the arm 9 in FIG. 5).

The operating area limiting system can prevent each section of the hydraulic excavator from intruding into the intrusion prohibition region 60, and thus it becomes possible for the operator to concentrate on excavation work in the true sense. Note that although the intrusion prohibition region 60 is set above the hydraulic excavator in the example illustrated in FIG. 5, the location of the intrusion prohibition region 60 is not limited to the position. For example, the intrusion prohibition position 60 can be set below or lateral side of the hydraulic excavator, and can also have shapes like a sector other than a straight line.

The system illustrated in FIG. 4 includes a work-machine-posture sensor 51, an intrusion prohibition region setting device 52, an operator-operation sensor 53, a control selecting device 54 that selects enabling or disabling of the operating area limiting control, a display device (monitor) 55 that can display a positional relationship between the intrusion prohibition region 60 and the hydraulic excavator, a main controller 57 of the hydraulic excavator, and the controller 40 that is responsible for the operating area limiting control.

The work-machine-posture sensor 51 is a sensor that senses postural data about the machine body 1B and the work implement 1A, and includes the boom-angle sensor 30, the arm-angle sensor 31, the bucket-angle sensor 32, the machine-body-inclination-angle sensor 33 and a swing angle sensor 34.

The intrusion prohibition region setting device 52 is an interface through which data about the intrusion prohibition region 60 (e.g. positional data about the boundary of the intrusion prohibition region 60) can be input. The setting of the intrusion prohibition region 60 via the intrusion prohibition region setting device 52 may be performed manually by an operator. In addition, the intrusion prohibition region setting device 52 may be connected with an external terminal, and the external terminal may be used for setting the intrusion prohibition region 60. Note that the intrusion prohibition region 60 can be set in a desired coordinate system such as a local coordinate system set for the excavator (e.g. the upper swing structure 12), a global coordinate system (a geographic coordinate system) or a site coordinate system set for a site.

The operator-operation sensor 53 includes pressure sensors 70*a* to 75*a* and pressure sensors 70*b* to 75*b* that acquire operation pressures generated on the pilot lines 144 to 149 as a result of operation of the operation levers 22 and 23 by an operator. That is, operation related to the hydraulic actuators 3 to 7 is sensed.

The control selecting device 54 is, for example, a switch provided on an upper end section of the front surface of the operation lever 22*a* having a joystick-like shape, and is pressed by a thumb of the operator gripping the operation lever 22*a*. The control selecting device 54 is a momentary switch, and switches the operating area limiting control between enabling (ON) and disabling (OFF) every time the control selecting device 54 is pressed. The switch position (ON position/OFF position) of the control selecting device 54 is input to the controller 40. Note that the installation location of the control selecting device 54 is not limited to the operation lever 22*a* (22*b*), and the control selecting device 54 may be provided at another location. For example, the control selecting device 54 may be provided on the display device 55. In addition, the control selecting device 54 is not necessarily be configured as hardware. For example, the display device 55 may be configured as a touch panel, and the control selecting device 54 may be configured as a graphical user interface (GUI) displayed on the screen.

The main controller 57 of the hydraulic excavator is a controller that can acquire, as data indicating whether or not the hydraulic excavator 1 is in a situation where operation of the hydraulic excavator 1 by an operator is enabled (operability data) from individual sensors, data indicating the ON state/OFF state of the engine 18 (ON/OFF information), the positional data about the gate lock lever (lock position/unlock position), and data about the opened/closed state of the door of the cab on the upper swing structure 12 (opened/closed information). The main controller 57 outputs the acquired data (the operability data about operation of the work machine by an operator) to the controller 40. In a case where the engine 18 is in the ON state, the gate lock lever is at the lock position, and the cab door is in the closed state, it is considered that the hydraulic excavator 1 is in a state in which operation of the hydraulic excavator 1 by an operator is enabled. On the other hand, in a case where the engine 18 in the OFF state, the gate lock lever is at the unlock position, and the cab door is in the opened state, it is considered that the hydraulic excavator 1 is in a state in which operation of the hydraulic excavator 1 by an operator is disabled. Note that the ON state/OFF state of the engine 18 may be determined from the position of the key switch (OFF position, ON position, or START position).

As illustrated in FIG. 2, the control hydraulic unit 160 is provided on the pilot lines of all the operation devices of the boom cylinder 5, the arm cylinder 6, the bucket cylinder 7, the swing motor 4 and the travel motor 3. FIG. 3 illustrates details of the control hydraulic unit 160. An explanation is given by using the boom cylinder 5 as an example. Solenoid proportional valves 84*a* and 84*b* electrically connected to the controller 40 are installed on the pilot lines 144*a* and 144*b*. On the basis of control signals from the controller 40, the solenoid proportional valves 84*a* and 84*b* can reduce the pilot pressures in the pilot lines 144*a* and 144*b*, and output the reduced pilot pressures. In addition, although an explanation is given by using the pilot line 144 related to the boom cylinder here, solenoid proportional valves 84 to 89 are provided such that pilot pressures related to the other hydraulic actuators 3, 4, 6, and 7 can also be reduced on the basis of commands from the controller 40.

The solenoid proportional valves 84 to 89 have the largest openings when not supplied with currents, and the openings decrease as the currents, which are control signals from the controller 40, are increased. That is, pilot pressures that are reduced from pilot pressures generated by operation of the operation levers 22 and 23 by an operator can be generated, and the velocities of operation of all the hydraulic actuators can be forcibly reduced from velocities that are otherwise produced from the operation by the operator.

In FIG. 4, the controller 40 has an input interface 91, a central processing unit (CPU) 92 that is a processor, a read-only memory (ROM) 93 and a random access memory (RAM) 94 that are storage devices, and an output interface 95. The input interface 91 receives inputs of signals from the angle sensors 30, 31, 32, and 34 and the inclination angle sensor 33 included in the work-machine-posture sensor 51, a signal from the intrusion prohibition region setting device 52 that is a device for setting the intrusion prohibition region 60, a signal from the operator-operation sensor 53 that is a pressure sensor (including the pressure sensors 70 to 75) that senses operation amounts given from the operation devices 45 to 47, and signals indicating the switch position of the control selecting device 54 (the ON position for enabling the operating area limiting control, and the OFF position for disabling the control). The input interface 91 converts the signals such that the CPU 92 can perform calculations with the signals. The ROM 93 is a recording medium storing a control program for executing the operating area limiting control including processes related to flowcharts mentioned below, various types of data necessary for execution of the flowcharts, and the like, and the CPU 92 performs a predetermined calculation process on signals taken in from the input interface 91 and the memories 93 and 94 according to the control program stored on the ROM 93. The output interface 95 creates signals to be output according to results of calculations at the CPU 92, and outputs the signals to the solenoid proportional valves 84 to 89 or the display device 55. Thereby, the hydraulic actuators 3 to 7 are driven/controlled, or images of the front work implement 1A, the machine body 1B, the bucket 10, the intrusion prohibition region 60 and the like are displayed on the screen of the display device 55.

Note that although the controller 40 illustrated in FIG. 4 includes the semiconductor memories, which are the ROM 93 and the RAM 94, as storage devices, any storage devices can be replaced with them, and for example, the controller 40 may include a magnetic storage device such as a hard disk drive.

Figure 6:
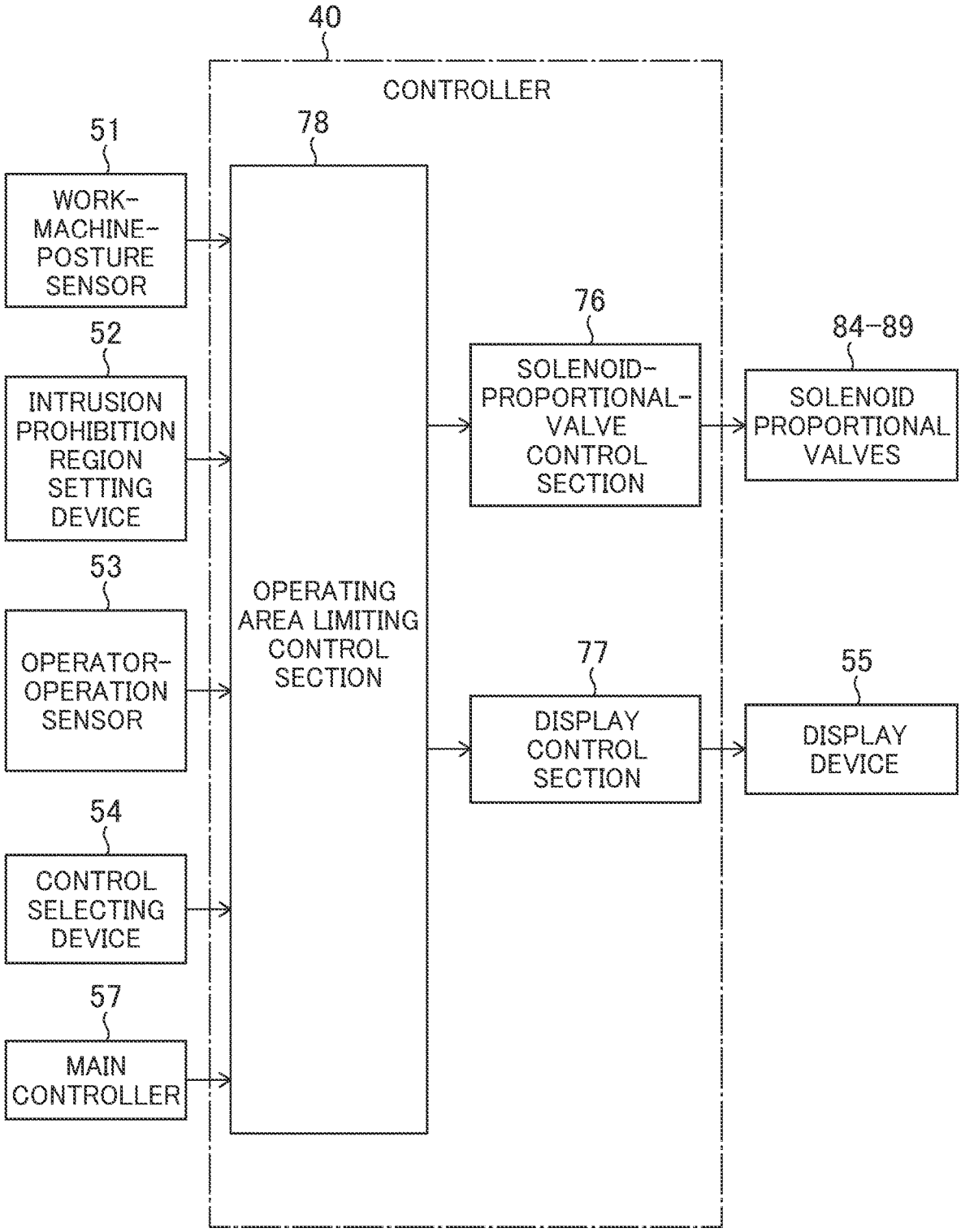
FIG. 6 is a functional block diagram of the controller.

FIG. 6 is a functional block diagram of the controller 40. The controller 40 includes an operating area limiting control section 78, a solenoid-proportional-valve control section 76 and a display control section 77.

The display control section 77 is a section that controls the display device (monitor) 55 on the basis of the work machine posture and the positional data about the intrusion prohibition region 60 output from the operating area limiting control section 78. The display control section 77 includes a display ROM storing a large number of pieces of display-related data including images and icons of the front work implement 1A and the machine body 1B, and, on the basis of a flag included in input data, the display control section 77 reads out a predetermined program, and additionally performs display control of the display device 55.

Figure 7:
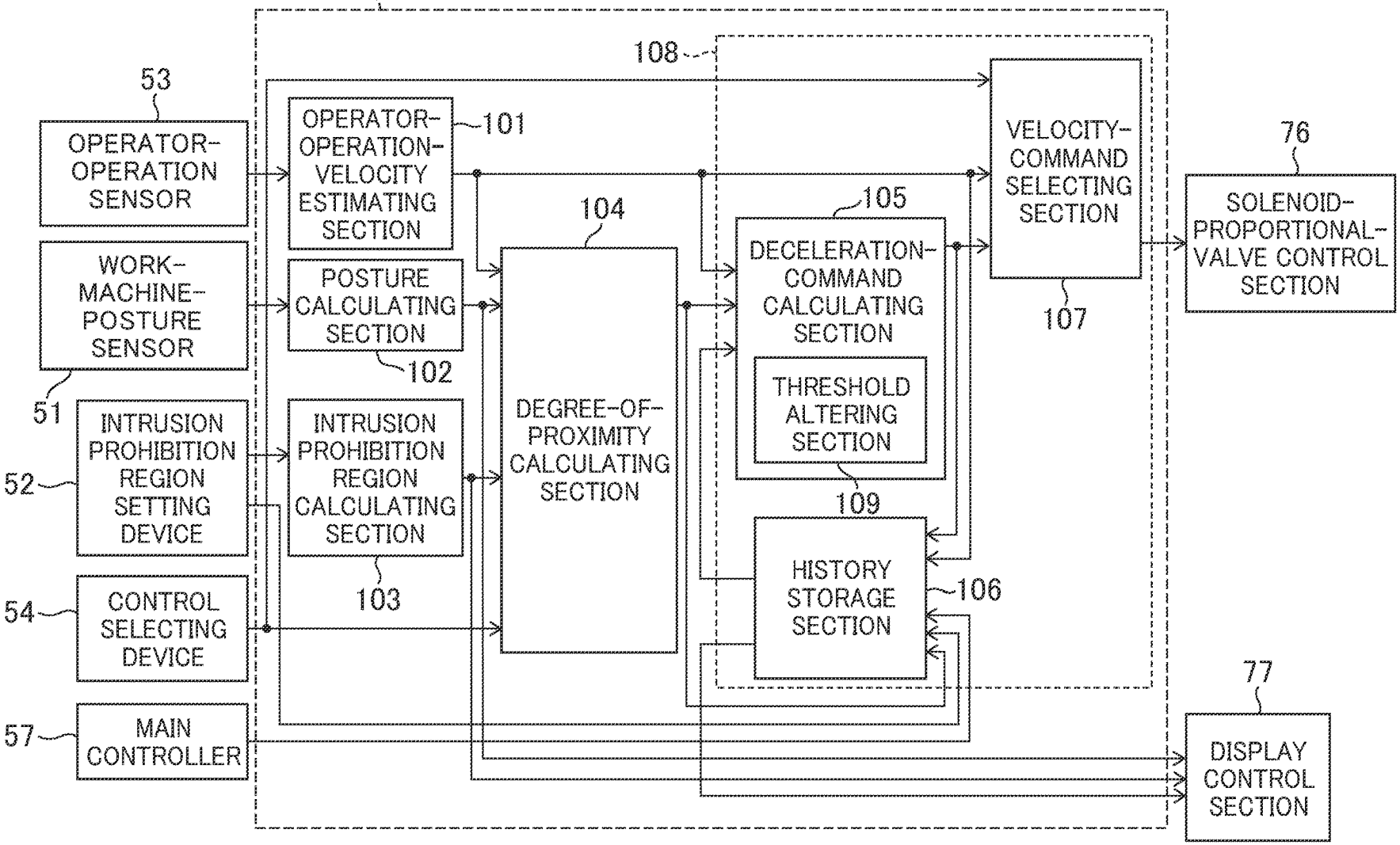
FIG. 7 is a detailed functional block diagram of the controller.

FIG. 7 is a functional block diagram of the operating area limiting control section 78 illustrated in FIG. 6. The operating area limiting control section 78 includes an operator-operation-velocity estimating section 101, a posture calculating section 102, an intrusion prohibition region calculating section 103, a degree-of-proximity calculating section 104, a history storage section 106, a deceleration-command calculating section 105 and a velocity-command selecting section 107. Among these, the deceleration-command calculating section 105, the history storage section 106 and the velocity-command selecting section 107 are collectively referred to as a control command section 108 in some cases. The control command section 108 executes operating area limiting control (deceleration control) of decelerating at least one of the plurality of hydraulic actuators 3 to 7 such that intrusions of the front work implement 1A and the machine body 1B into the intrusion prohibition region 60 are prevented.

Figure 18:
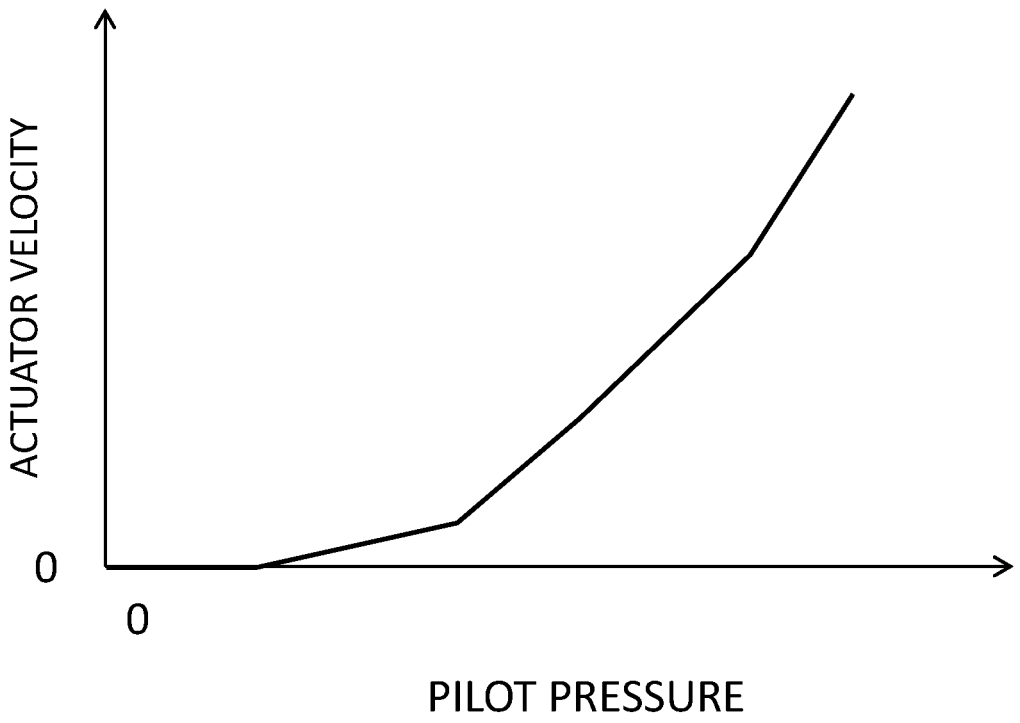
FIG. 18 is a figure illustrating a table of a correlation between pilot pressures and actuator velocities.

On the basis of pilot pressures input from the operator-operation sensor 53 including the pressure sensors 71 to 75, the operator-operation-velocity estimating section 101 uses a table of a correlation between pilot pressures and actuator velocities (see FIG. 18) retained in advance in the controller 40 to estimate the velocities of the hydraulic actuators 3 to 7 produced by operator operation. Note that computations of operation amounts by the pressure sensors 70, 71 and 72 are merely one example. For example, position sensors (e.g. rotary encoders) that sense the rotational displacement of each operation lever of the operation levers 22 and 23 may sense the operation amounts of the operation levers, a table of a correlation between lever operation amounts and pilot pressures may be used to compute pilot pressures from the sensed lever operation amounts, and the velocities of the hydraulic actuators 3 to 7 may be estimated. In addition, instead of the configuration in which operation velocities are computed from the amounts of operation produced by an operator, the expansion/contraction amounts of the hydraulic cylinders 5, 6 and 7 may be computed from sensing values of the angle sensors 30 to 32, and the operation velocities may be computed on the basis of temporal changes of the expansion/contraction amounts. In addition, temporal changes of the swing angle may be computed on the basis of temporal changes of the sensing value of the swing angle sensor 34.

On the basis of data from the work-machine-posture sensor 51, the posture calculating section 102 calculates the posture and position of the hydraulic excavator 1 in the local coordinate system. The posture of the hydraulic excavator 1 can be defined in the excavator coordinate system (local coordinate system) illustrated in FIG. 5. The excavator coordinate system illustrated in FIG. 5 has its origin at the swing center axis. The direction in which the advancing direction of the lower track structure 11 when it moves straight and the operation plane of the front work implement 1A becomes parallel, and in which the operation direction in the direction of expansion of the front work implement 1A, and the operation direction of the lower track structure 11 when it moves forward match is set as the X axis, the swing center of the upper swing structure 12 is set as the Z axis, and the Y axis is set such that it forms a right-handed coordinate system together with the X axis and the Z axis mentioned before. In addition, the swing angle is defined such that it is 0 in a state in which the front work implement 1A is parallel to the X axis. The rotation angle of the boom 8 relative to the X axis is defined as the boom angle α, the rotation angle of the arm 9 relative to the boom 8 is defined as the arm angle β, the rotation angle of the claw tip of the bucket 10 relative to the arm 9 is defined as the bucket angle γ, and the swing angle of the upper swing structure relative to the lower swing structure is defined as a swing angle δ. The boom angle α is sensed by the boom-angle sensor 30, the arm angle β is sensed by the arm-angle sensor 31, the bucket angle γ is sensed by the bucket-angle sensor 32, and the swing angle δ is sensed by the swing angle sensor 34. By using data about these angles, and dimensional data about each section of the hydraulic excavator, it is possible to calculate the posture and position of each section of the hydraulic excavator in the excavator coordinate system. In addition, the angle of inclination θ of the machine body 1B relative to a horizontal plane (reference plane) perpendicular to the direction of gravity can be sensed by the machine-body-inclination-angle sensor 33.

On the basis of data from the intrusion prohibition region setting device 52, the intrusion prohibition region calculating section 103 executes a calculation of converting the positional data about the intrusion prohibition region 60 into data in the excavator coordinate system illustrated in FIG. 5. Although the intrusion prohibition region 60 expressed in a two-dimensional space is illustrated in the present embodiment as illustrated in FIG. 5, the intrusion prohibition region 60 may be expressed in a three-dimensional space. In addition, there may be a plurality of intrusion prohibition regions 60.

At the time of operation of the operation levers 22 and 23 by an operator, the degree-of-proximity calculating section 104 calculates the degree of proximity of an operating-area-limiting-control target portion of the hydraulic excavator 1 to the intrusion prohibition region 60. The degree of proximity is an index value indicating the proximity of an operating-area-limiting-control target portion on the front work implement 1A and the machine body 1B to the preset intrusion prohibition region 60. As the degree of proximity, for example, the distance between the operating-area-limiting-control target portion and the intrusion prohibition region 60 may be used, or a predicted length of time taken for contact of the operating-area-limiting-control target portion with the intrusion prohibition region 60, which is data taking into consideration the operation velocity of the excavator in addition to the distance mentioned above, may be used. A point on the excavator that can intrude into the intrusion prohibition region 60 may be set as the operating-area-limiting-control target portion on the front work implement 1A and the machine body 1B, and, for example, the tip of the bucket 10 or an arm rear end section 9*b* (see FIG. 15) can be set. In addition, it is also possible to calculate the degrees of proximity of a plurality of points on the front work implement 1A and the machine body 1B, and to select, as an operating-area-limiting-control target portion, a point evaluated as being closest to the intrusion prohibition region 60 of the points (e.g. a point having the shortest distance to the intrusion prohibition region in a case where distances are selected as degrees of proximity).

Figure 15:
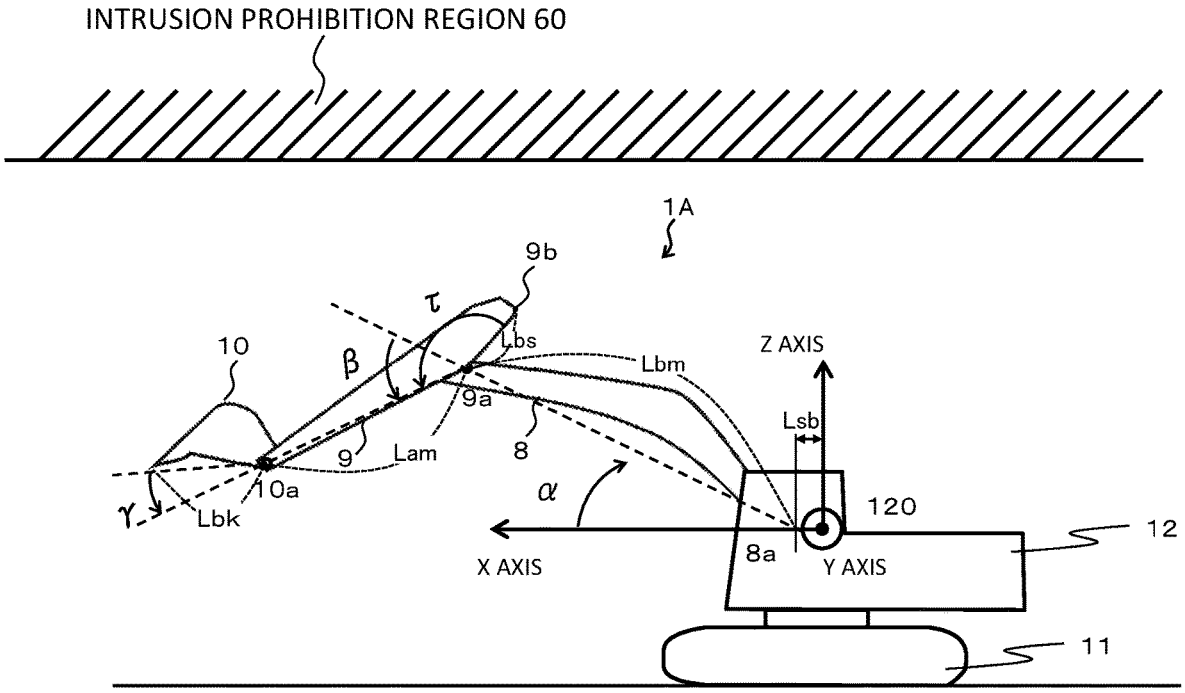
FIG. 15 is a figure illustrating the coordinate system of the hydraulic excavator.

The position of an operating-area-limiting-control target portion (in the following, also referred to as a control target portion) is calculated in the following manner. Here, calculations of the position and velocity of a control target portion in a case where the swing center 120 of the upper swing structure 12 is used as a reference point are explained. As illustrated in FIG. 15, the length in the X axis direction between the swing center 120 of the upper swing structure 12 and the boom pin 8*a* is defined as Lsb, the length from the boom pin 8*a* to the arm pin 9*a* is defined as Lbm, the length from the arm pin 9*a* to the bucket pin 10*a* is defined as Lam, the length from the bucket pin 10*a* to the bucket tip 10*b* is defined as Lbk, and the angles of pivoting motion of the boom 8, the arm 9 and the bucket 10 are defined as α, β and γ. Note that it is assumed that the swing center 120 and the boom pin 8 are aligned in the Z-axis direction and the Y-axis direction. At this time, the horizontal position Xbk and vertical position Zbk of the bucket tip 10*b* are expressed by the following formulae, respectively.

$$X_{bk}=L_{bm}\cos\alpha+L_{am}\cos(\alpha+\beta)+L_{bk}\cos(\alpha+\beta+\gamma)+L_{sb}$$

$$Z_{bk}=L_{bm}\sin\alpha-L_{am}\sin(\alpha+\beta)-L_{bk}\sin(\alpha+\beta+\gamma) \quad \text{[Equation 1]}$$

Next, if it is assumed that the pivot angle velocities of the boom 8, the arm 9 and the bucket 10 are ωα, ωβ and ωγ, the horizontal velocity $V_{Xbk}$, and vertical velocity $V_{Zbk}$ of the bucket tip 10*b* are expressed by the following formulae, respectively.

$$V_{Xbk}=-\omega_\alpha L_{bm}\sin\alpha-(\omega_\alpha+\omega_\beta)L_{am}\sin(\alpha+\beta)-(\omega_\alpha+\omega_\beta+\omega_\gamma)\sin(\alpha+\beta+\gamma)$$

$$V_{Zbk}=-\omega_\alpha L_{bm}\cos\alpha-(\omega_\alpha+\omega_\beta)L_{am}\cos(\alpha+\beta)-(\omega_\alpha+\omega_\beta+\omega_\gamma)\cos(\alpha+\beta+\gamma) \quad \text{[Equation 2]}$$

As illustrated in FIG. 15, the positions and velocities of other portions other than the bucket tip of the hydraulic excavator 1 like the arm rear end section 9*b* (see FIG. 15) can also be computed. The positions Xamr and Zamr, and velocities $V_{Xamr}$ and $V_{Zamr}$ of the arm rear end section 9*b* can be computed according to the following formulae. It should be noted however that as illustrated in FIG. 15, Lbs is the distance from the arm pin 9*a* to the arm rear end section 9*b*, and τ is geometric data illustrated in FIG. 15. In this manner, by using geometric data about the hydraulic excavator 1*a*, the positions and velocities of other portions of the front work implement 1A can also be computed similarly.

$$X_{amr}=L_{bm}\cos\alpha+L_{bs}\cos(\alpha+\beta-\tau)+L_{sb}$$

$$Z_{amr}=-L_{bm}\sin\alpha-L_{bs}\cos(\alpha+\beta-\tau)$$

$$V_{Xamr}=-\omega_\alpha L_{bm}\sin\alpha-(\omega_\alpha+\omega_\beta)L_{bs}\sin(\alpha+\beta-\tau)$$

$$V_{Zamr}=-\omega_\alpha L_{bm}\cos\alpha-(\omega_a+\omega_\beta)L_{bs}\cos(\alpha+\beta-\Sigma) \quad \text{[Equation 3]}$$

In addition, it becomes possible to compute the distance between the intrusion prohibition region 60 and a control target portion by using the positions of the intrusion prohibition region 60 and the control target portion. Here, an explanation is given by mentioning a case where the control target portion is the bucket tip 10*b* as an example. When the swing center 120 of the upper section swing pair is used as a reference point, and the distance to the intrusion prohibition region 60 set above the hydraulic excavator 1 is defined as Az, the distance Dzbk of the bucket tip 10*b* to the intrusion prohibition region 60 is expressed by the following formula.

$$D_{zbk}=A_z-Z_{bk} \quad \text{[Equation 4]}$$

The predicted length of time Tzbk taken for the contact of the bucket tip 10*b* with the intrusion prohibition region 60 can be computed in the following manner by using the computed Dzbk and $V_{Zbk}$.

$$T_{zbk}=D_{zbk}/V_{zbk} \quad \text{[Equation 5]}$$

Similarly, for example, the distance Dzamr in a case of the arm rear end section 9*b*, and the predicted length of time Tzamr taken for the contact of the arm rear end section 9*b* can be computed in the following manner.

$$D_{zamr}=A_z-Z_{amr}$$

$$T_{zamr}=D_{zamr}/V_{Zamr}$$

In a case where the degree-of-proximity calculating section 140 has computed a plurality of distances (degrees of proximity) Tzbk and Tzamr in this manner, a section having the shortest distance among them can be selected as a control target portion. It should be noted however that in a case where the portion having the shortest distance does not operate on the basis of operator operation, the portion related to the distance may be excluded from control target portions.

On the basis of the degree of proximity calculated at the degree-of-proximity calculating section 104, and history data about degrees of proximity stored in the history storage section 106 mentioned below, the deceleration-command calculating section 105 calculates a deceleration command according to the degree of proximity. More specifically, when the proximity specified by the degree of proximity related to the control target portion calculated at the degree-of-proximity calculating section 104 is closer than the proximity specified by a degree-of-proximity threshold set as a threshold for the degree of proximity, the deceleration-command calculating section 105 calculates a deceleration command for decelerating at least one of the hydraulic actuators that drive the control target portion such that an intrusion of the control target portion into the intrusion prohibition region 60 is prevented. For example, in a case where a distance between an operating-area-limiting-control target portion (e.g. the arm rear end section 9*b*) and the intrusion prohibition region 60 is input from the degree-of-proximity calculating section 104 as the degree of proximity, when the distance is shorter than the degree-of-proximity threshold (also referred to as a "distance threshold" in a case where the degree of proximity is a distance), a deceleration command is calculated. Then, when the distance is shorter than the degree-of-proximity threshold, on the basis of the distance and a table (see FIGS. 11 and 12 mentioned below) in which a relationship between distances and deceleration rates is predefined in advance, the deceleration-command calculating section 105 calculates a deceleration rate of a hydraulic actuator (e.g. the boom cylinder 5) that operates the control target portion. Lastly, the deceleration-command calculating section 105 uses the calculated deceleration rate and the velocity of the hydraulic actuator that operates the control target portion calculated at the operator-operation-velocity estimating section 101, to calculate a velocity of the hydraulic actuator that is necessary for preventing an intrusion into the intrusion prohibition region 60.

In addition, a threshold altering section 109 in the deceleration-command calculating section 105 uses the history data about degrees of proximity input from the history storage section 106 to alter the degree-of-proximity threshold. In the present embodiment, the degree-of-proximity threshold is used also when the deceleration rate of the hydraulic actuator operating the control target portion is calculated, and is a degree of proximity used for determining whether to start deceleration of the hydraulic actuator by the operating area limiting control. That is, in this configuration, the degree of proximity used for determining whether to start deceleration of actuators is changed according to the history data about degrees of proximity.

Regarding the same one of the hydraulic actuators 3 to 7, the velocity-command selecting section 107 compares the velocity (operator operation velocity) of the hydraulic actuator produced by operator operation and estimated by the operator-operation-velocity estimating section 101 with the hydraulic actuator velocity calculated at the deceleration-command calculating section 105, and selects one having a smaller absolute value as the target velocity of the hydraulic actuator. For example, in a case where the hydraulic actuator velocity calculated at the deceleration-command calculating section 105 is selected, the selected actuator velocity is output to the solenoid-proportional-valve control section 76 such that the velocity of the target actuator is decelerated.

The history storage section 106 stores the history data about degrees of proximity by storing degrees of proximity calculated at the degree-of-proximity calculating section 104 in a time series. The history storage section 106 is a storage region provided in the storage devices (ROM 93 and RAM 94) in the controller 40, and various types of data including the history data about degrees of proximity are stored. Note that this storage region may be provided on another storage device positioned outside the controller 40, and mounted on the work machine. In addition, the history data retained in the history storage section 106 is output to the deceleration-command calculating section 105. As history data other than this, for example, data in a time series about actuator velocities calculated at the deceleration-command calculating section 105, operator operation velocities calculated at the operator-operation-velocity estimating section 101, the ON state/OFF state of the engine 18 (positional states (OFF position, ON position, and START position) of the key switch according to operator operation), positional information (lock position/unlock position) of the gate lock lever, and the opened/closed state (opened state/closed state) of the cab door from the main controller 57, and the like may be stored along with acquisition times of the individual pieces of data.

On the basis of the target velocity of each of the actuators 3 to 7 output from the velocity-command selecting section 107, the solenoid-proportional-valve control section 76 calculates and outputs a command to each of the solenoid proportional valves 84 to 89. Thereby, since the pilot pressures in the pilot lines 144 to 149 are adjusted as appropriate according to the target velocities, each of the actuators 3 to 7 is operated at the velocity selected at the velocity-command selecting section 107.

Figure 8:
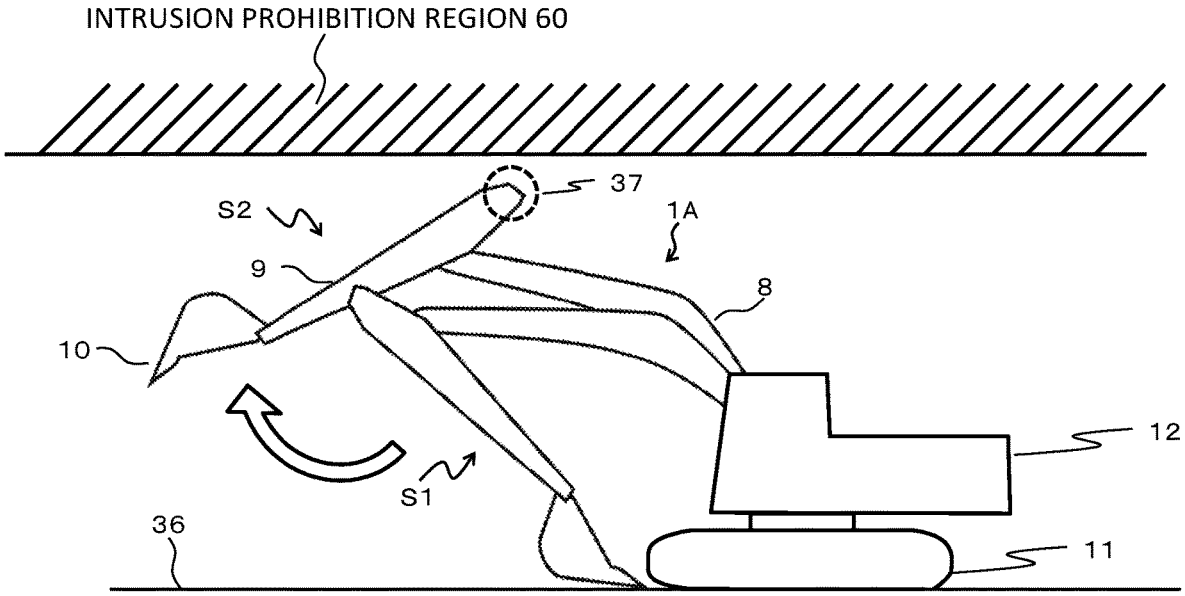
FIG. 8 is a figure illustrating an example of an intrusion prohibition region and excavator work.

Here, an example of actuator operation limitation by the operating area limiting control is illustrated in FIG. 8. FIG. 8 illustrates State S1 where excavation work is completed and the front work implement 1A is crowded, and State S2 where reaching work for next excavation work is being performed, in one cycle of repeatedly performed excavation work. During the transition from State S1 to State S2, operation of raising the boom 8 is performed by an operator in order to prevent the bucket 10 from contacting an excavation surface 36, but in a case where the operation of raising the boom 8 is excessive, there is a possibility that a rear end section 37 of the arm 9 intrudes into the intrusion prohibition region 60. When the raising operation of the boom 8 is excessive in a situation where the transition from State S1 to State S2 is occurring as illustrated in FIG. 8, the deceleration-command calculating section 105 calculates a command for decelerating the boom-raising operation (i.e. the expansion operation of the boom cylinder) in order to prevent the rear end section 37 of the arm 9 from intruding into the intrusion prohibition region 60. In other words, in a case where the distance of the front work implement 1A to the intrusion prohibition region 60 is shorter than the degree-of-proximity threshold, that is, in a case where the front work implement 1A is in proximity to the intrusion prohibition region 60, a command for decelerating the boom-raising operation is calculated. Thereby, intervention operation (operating area limiting control) is performed on the operation performed by the operator such that the front work implement 1A does not intrude into the intrusion prohibition region 60. In a case where the distance to the intrusion prohibition region 60 is longer than the degree-of-proximity threshold, the intervention operation is not performed, and the excavator operates according to the operation performed by the operator.

At this time, irrespective of whether or not the operating area limiting control is executed, the history storage section 106 stores the degree of proximity (e.g. a distance) calculated at the degree-of-proximity calculating section 104, the actuator velocity (deceleration command) calculated at the deceleration-command calculating section 105, and the actuator velocity (operator operation velocity) calculated at the operator-operation-velocity estimating section 101.

For example, when the history data stored in the history storage section 106 is about distances between the intrusion prohibition region 60 and the excavator 1, the deceleration-command calculating section 105 (control command section 108) executes the operating area limiting control when a distance therebetween is shorter than the degree-of-proximity threshold. At this time, on the basis of the history data about the distances, the threshold altering section 109 calculates the dispersion of the distances (e.g. the variance or standard deviation), and alters the degree-of-proximity threshold used for determining whether to start a computation of a deceleration command by the deceleration-command calculating section 105, according to the value of the dispersion. For example, when the dispersion of the distances is equal to or larger than a predetermined threshold (a dispersion threshold), the degree-of-proximity threshold of distances used for determining whether to start a computation of a deceleration command is kept at an initial value (dth1), and when the dispersion is smaller than the dispersion threshold, the degree-of-proximity threshold is altered to a value (dth2) smaller than the initial value. Thereby, it is possible to make the control intervention less likely to occur. Note that although the degree-of-proximity threshold is changed between the two values depending on whether or not the dispersion of distances is equal to or larger than the dispersion threshold in the case explained, it is also possible to lower the degree-of-proximity threshold as the dispersion of distances decreases.

In a case where the operating area limiting control is set to be enabled (ON) at the control selecting device 54, and a velocity that is decelerated from an operator operation velocity is to be output by the deceleration-command calculating section 105, the velocity-command selecting section 107 gives a command to the solenoid-proportional-valve control section 76 such that the hydraulic actuators 3 to 7 are driven at the velocity. On the other hand, in a case where the deceleration-command calculating section 105 does not output an actuator velocity or in a case where the operating area limiting control is set to be disabled (OFF) at the control selecting device 54, no signals are sent to the solenoid-proportional-valve control section 76, and the hydraulic actuators 3 to 7 are driven according to operation by an operator.

Figure 9:
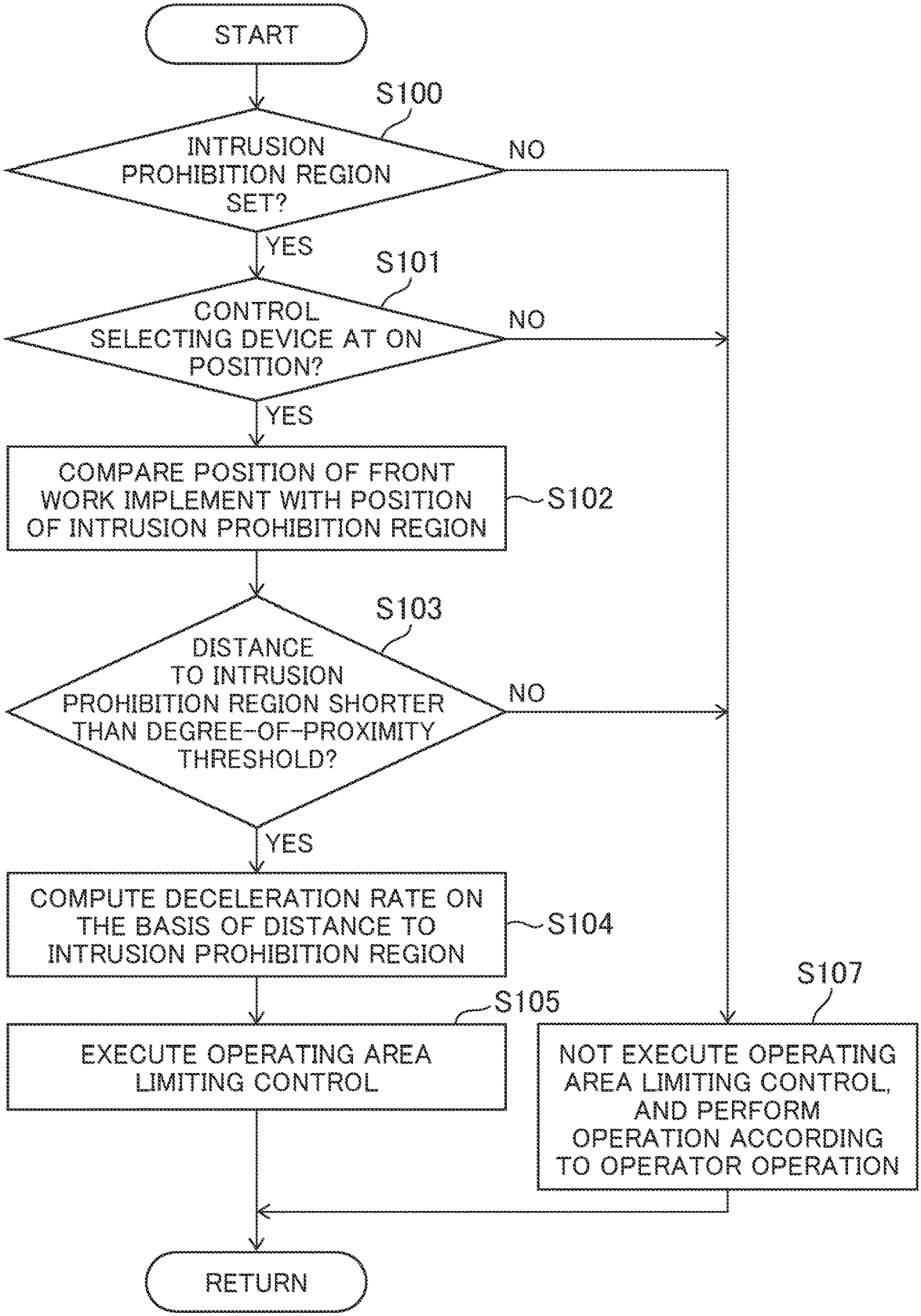
FIG. 9 is a figure illustrating a flowchart of operating area limiting control.
Figure 10:
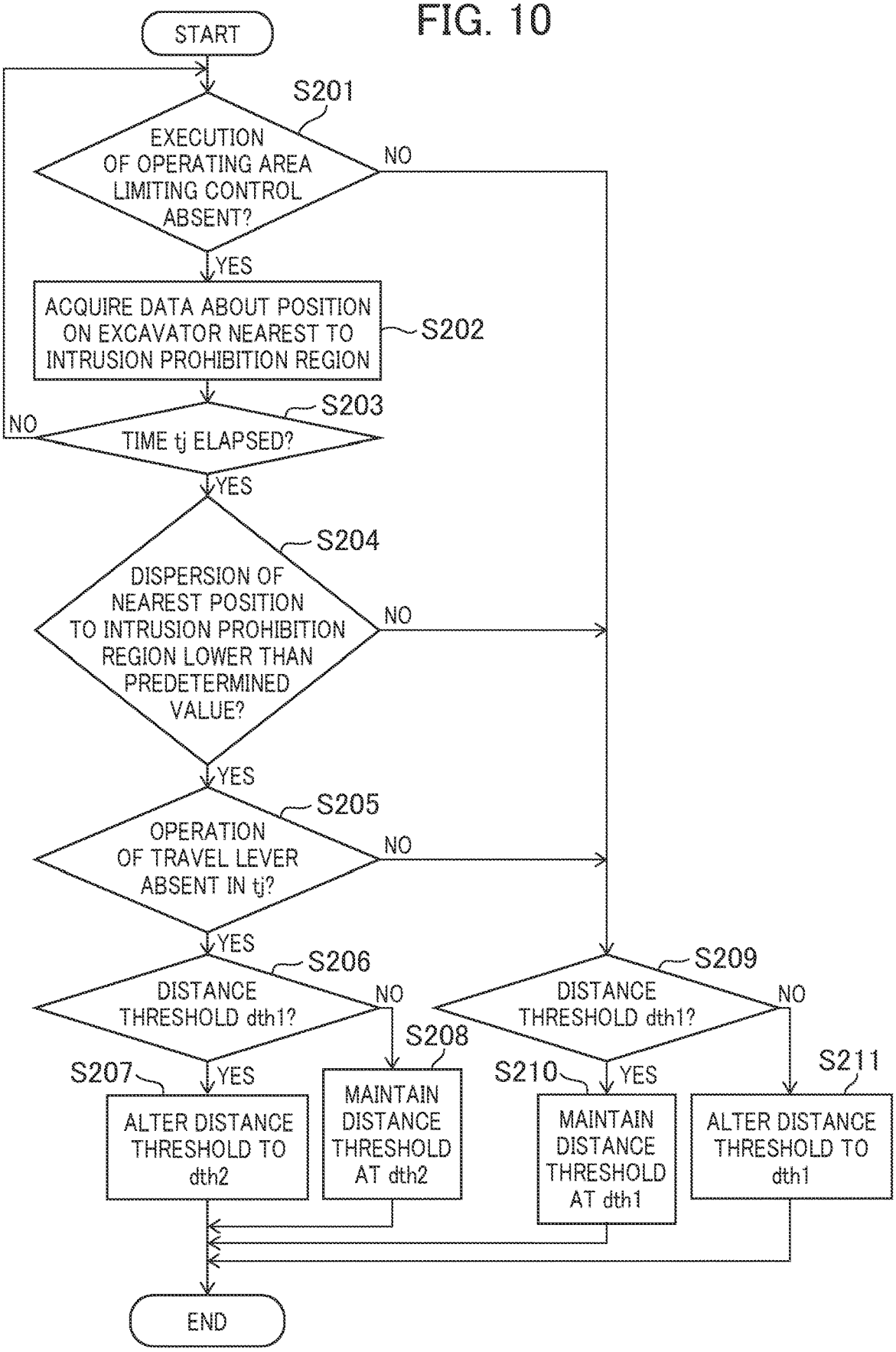
FIG. 10 is a figure illustrating a flowchart of an alteration of a distance threshold according to a first embodiment.

A control flow of the operating area limiting control section 78 is explained by using FIG. 9 and FIG. 10. For the sake of simplicity, the target of the operating area limiting control here is the front work implement 1A.

First, at Step S100 in FIG. 9, the degree-of-proximity calculating section 104 receives an input of positional data about the intrusion prohibition region 60 from the intrusion prohibition region calculating section 103, and determines whether or not the intrusion prohibition region 60 has been set. In a case where the intrusion prohibition region 60 has been set, the process proceeds to Step S101. On the other hand, in a case where the intrusion prohibition region 60 has not been set, the process proceeds to Step S107.

At Step S101, the degree-of-proximity calculating section 104 determines whether or not the operating area limiting control is set to be enabled (ON) at the control selecting device 54. In a case where the operating area limiting control is set to be enabled (ON), the process proceeds to Step S102.

Otherwise (i.e. in a case where the operating area limiting control is disabled (OFF), the process proceeds to Step S107.

At Step S102, on the basis of data of the posture calculating section 102 and the intrusion prohibition region calculating section 103, the degree-of-proximity calculating section 104 compares the position of each section of the front work implement 1A with the position of the intrusion prohibition region 60, calculates the shortest distance from the boundary of the intrusion prohibition region 60 to the front work implement 1A, and sets the degree of proximity to the shortest distance. Note that a plurality of locations on the front work implement 1A, for which distances to the boundary of the intrusion prohibition region 60 are calculated, may be decided in advance, and the shortest one of the distances may be calculated as the degree of proximity. After the calculation at Step S102 is completed, the process proceeds to Step S103.

At Step S103, the deceleration-command calculating section 105 determines whether or not the distance (degree of proximity) computed at Step S102 is shorter than a first threshold (dth1 or dth2 mentioned below). In a case where the distance computed at Step S102 is shorter than the degree-of-proximity threshold (dth1 or dth2), the process proceeds to Step S104. In addition, in a case where the distance computed at Step S102 is equal to or longer than the degree-of-proximity threshold, the process proceeds to Step S107.

At Step S104, the deceleration-command calculating section 105 computes a deceleration rate r of the actuators 5 to 7 on the basis of the distance computed at Step S102. The deceleration rate r in the present embodiment is a value equal to or larger than zero, and equal to or smaller than 1. The deceleration rate r equal to 0 is defined as meaning that the actuators 5 to 7 are not to be decelerated, and the deceleration rate r equal to 1 is the highest deceleration rate and is defined as meaning that the actuators 5 to 7 are to be stopped. The relationship between distances and deceleration rates can be defined as a relationship like the one illustrated in FIG. 11, for example. After the deceleration rate is computed, the process proceeds to Step S105.

At Step S105, the deceleration-command calculating section 105 firstly decides a deceleration-target hydraulic cylinder in the three actuators 5 to 7 that operate the front work implement 1A. In the present embodiment, in a case where (1) the distance (degree of proximity) calculated at Step S102 is shorter than the degree-of-proximity threshold, and (2) the velocity vector of the point for which the distance (degree of proximity) has been calculated at Step S102 is in the direction toward the intrusion prohibition region 60, (3) an actuator among the three actuators 5 to 7 operating the front work implement 1A, which causes the front work implement 1A to generate a velocity vector having a direction toward the intrusion prohibition region 60, is set as a deceleration target. For example, when the arm cylindered 6 operates the arm rear end section 9*b* in a direction away from the intrusion prohibition region 60 and the boom cylinder 5 operates the arm rear end section 9*b* in a direction toward the intrusion prohibition region 60 in a case where the arm cylinder 6 and the boom cylinder 5 are operated by an operator in a situation where the rear end section 9*b* of the arm 9 is close to the intrusion prohibition region 60, the boom cylinder 5 bringing the arm rear end section 9*b* toward the intrusion prohibition region 60 is selected as a deceleration-target actuator. Note that a plurality of deceleration-target actuators may be selected if the deceleration-target actuators satisfy the conditions (1) to (3) described above. In addition, the condition (3) described above may be omitted, and all the actuators being operated by an operator may be set as deceleration targets in a case where the actuators satisfy the conditions (1) and (2) described above.

After a deceleration-target actuator is decided, on the basis of an operator operation velocity Vope calculated for the deceleration-target actuator at the operator-operation-velocity estimating section 101, and the deceleration rate r calculated at Step S104, the deceleration-command calculating section 105 calculates an actuator velocity Vctrl after deceleration, and outputs the calculated velocity Vctrl to the velocity-command selecting section 107 and the history storage section 106. The actuator velocity Vctrl after the deceleration can be calculated according to the following formula, for example.

$$V_{ctrl}=(1-r)V_{ope} \quad \text{[Equation 7]}$$

Subsequently, the velocity-command selecting section 107 compares the operator operation velocity Vope with the actuator velocity Vctrl after the deceleration to find which one is higher or lower, selects one having a smaller absolute value, and outputs it to the solenoid-proportional-valve control section 76. Thereby, the actuators 5 to 7 are automatically controlled such that the actuator velocities according to the deceleration rate r are attained. Note that as is obvious from the formula for Vctrl described above, in a case where the deceleration rate r is higher than zero, Vctrl is always selected at the velocity-command selecting section 107.

In a case where a result of any of the determinations at Step S100, Step S101 and Step S103 is NO, the process proceeds to Step S107, and the actuators are driven according to operation by the operator.

A flow of altering, based on the history data stored in the history storage section 106, the threshold (degree-of-proximity threshold) for distances to the intrusion prohibition region 60 used at Step S103 in FIG. 9 is explained by using FIG. 10.

First, at Step S201, the threshold altering section 109 (deceleration-command calculating section 105) determines whether or not the operating area limiting control is being unexecuted. In a case where the operating area limiting control is being unexecuted, the process proceeds to Step S202, and in a case where operating area limiting control is not being unexecuted, the process proceeds to Step S209.

At Step S202, the threshold altering section 109 acquires positional data of the point for which the distance (degree of proximity) has been calculated at Step S102 in FIG. 9 (the location on the front work implement 1A that is at the shortest distance from the intrusion prohibition region 60, and referred to as the "nearest position" in the following in some cases). For example, in a case of the situation illustrated in FIG. 8, the point corresponds to the arm rear end section 9*b*. After the positional data could be acquired, the process proceeds to Step S203.

At Step S203, the threshold altering section 109 determines whether or not a predetermined length of time tj determined in advance has elapsed. In a case where the predetermined length of time tj has not elapsed, Step S201 to Step S203 are repeated until the predetermined length of time tj elapses. After the predetermined length of time tj has elapsed, the process proceeds to Step S204.

Note that although any length of time (e.g. several minutes) can be set as the predetermined length of time tj, for example, the predetermined length of time tj may be set to a length of time having been taken for the front work implement 1A to repeat predetermined operation (excavation operation, soil-dropping operation, reaching operation) a predetermined number of cycles (e.g. ten cycles).

At Step S204, on the basis of the positional data of the nearest position on the front work implement 1A acquired at the Step S202 in the predetermined length of time tj, the threshold altering section 109 calculates the dispersion of the positional data, and determines whether or not the dispersion is smaller than a predetermined threshold (dispersion threshold). In a case where the dispersion is smaller than the dispersion threshold, the process proceeds to Step S205. On the other hand, in a case where the dispersion is equal to or larger than the dispersion threshold, the process proceeds to Step S209.

At Step S205, the threshold altering section 109 determines that travel-related lever operation (i.e. operation of the operation lever 23) is absent in the predetermined length of time tj. In a case where travel-related lever operation is absent, the process proceeds to Step S206. On the other hand, in a case where travel-related lever operation is performed, the process proceeds to Step S209.

At Step S206, the threshold altering section 109 determines whether or not the degree-of-proximity threshold used at the moment (at the moment of the execution of Step S206) is dth1 (initial value). In a case where it is determined that the degree-of-proximity threshold is dth1, the process proceeds to Step S207, and the degree-of-proximity threshold is altered from dth1 to dth2 (n.b. dth1>dth2). On the other hand, in a case where it is determined that the degree-of-proximity threshold is not dth1, that is, in a case where the degree-of-proximity threshold is dth2, the process proceed to Step S208, and the degree-of-proximity threshold is maintained at dth2 (an alteration of the degree-of-proximity threshold is not performed).

At Step S209, the threshold altering section 109 determines whether or not the degree-of-proximity threshold used at the moment (at the moment of the execution of Step S209) is dth1. In a case where it is determined that the degree-of-proximity threshold is dth1, the process proceeds to Step S210, and the degree-of-proximity threshold is maintained at dth1. On the other hand, in a case where it is determined that the degree-of-proximity threshold is not dth1, the process proceeds to Step S211, and the degree-of-proximity threshold is altered from dth2 to dth1.

Figure 11:
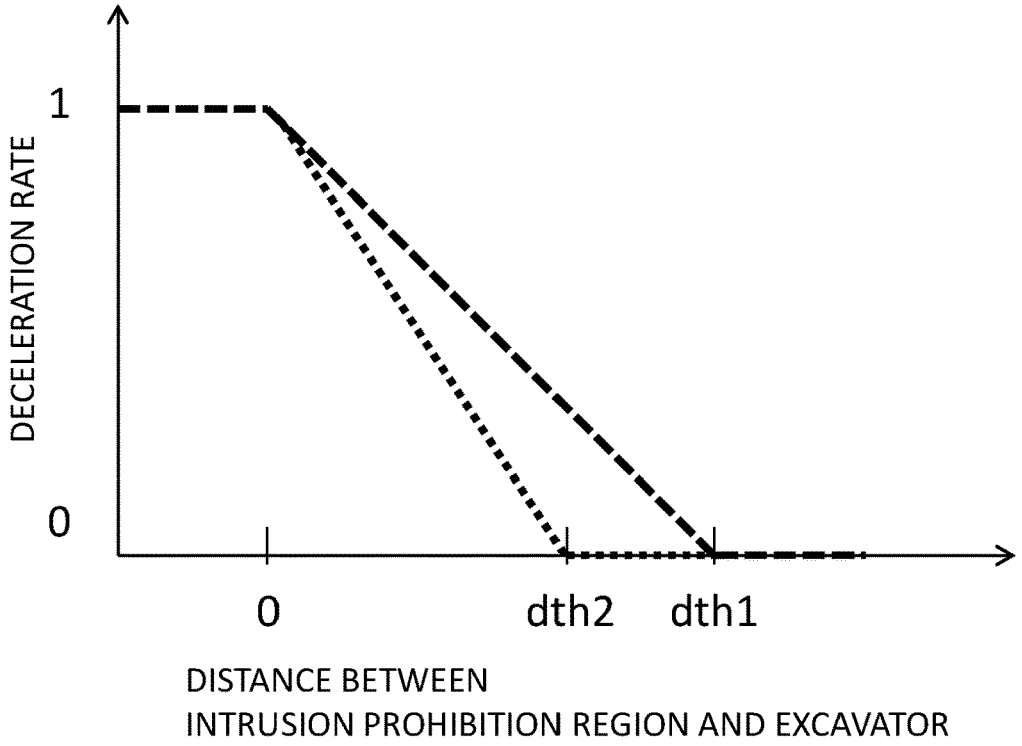
FIG. 11 is a figure illustrating a relationship between deceleration rates and distances to an intrusion prohibition region.
Figure 12:
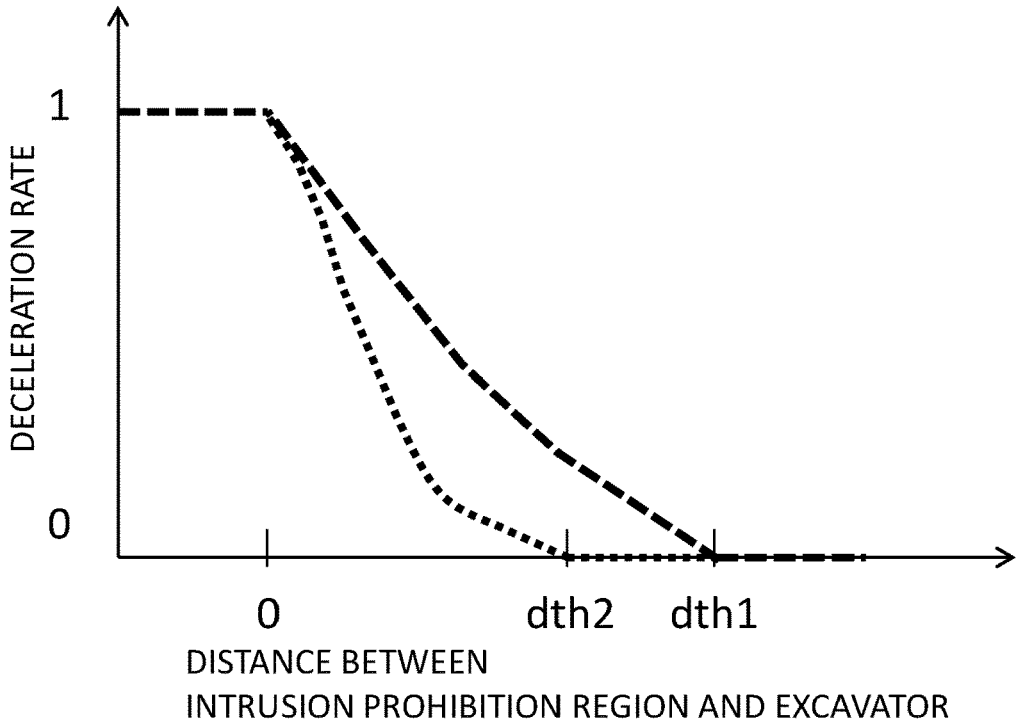
FIG. 12 is a figure illustrating a relationship between deceleration rates and distances to an intrusion prohibition region.

The degree-of-proximity thresholds dth1 and dth2 have a relationship of dth1>dth2 as illustrated in FIG. 11. Accordingly, in a case where the operating area limiting control is executed on the basis of dth2, the area where the hydraulic actuators 5 to 7 are allowed to operate according to operator operation is enlarged as compared with a case where the operating area limiting control is executed based on dth1. Note that the relationship between distances and deceleration rates r is not necessarily be limited to a linear relationship like the one illustrated in FIG. 11, for example, but may have a curvilinear relationship expressed by a polynomial as illustrated in FIG. 12.

After Steps S207, S208, S210, and S211 are completed, Step S201 is started at the timing when a next control cycle is started, and the above-mentioned process is repeated thereafter.

<Action/Effects>

In the present embodiment, in a case where the dispersion of positional data of the nearest position on the front work implement 1A relative to the intrusion prohibition region 60 is small, it is considered that an operator on the hydraulic excavator recognizes the intrusion prohibition region 60, and is skilled in the operation of the hydraulic excavator, and it is estimated that the possibility of intrusions of the excavator into the intrusion prohibition region 60 is low even if the nearest position is close to the intrusion prohibition region 60. In view of this, when the dispersion of positional data (degree of proximity) of the nearest position on the front work implement 1A relative to the intrusion prohibition region 60 in the predetermined length of time tj (Step S203 in FIG. 10) is smaller than the dispersion threshold, the hydraulic excavator of the present embodiment alters or maintains the degree-of-proximity threshold (distance threshold), which is a threshold for the degree of proximity used for determining whether to start the operating area limiting control, to or at the value (dth2) corresponding to a shorter distance to the intrusion prohibition region 60 (Steps S207 and S208). Thereby, as compared with a case where the degree-of-proximity threshold is fixed at dth1, frequent intervention by the operating area limiting control in operator operation is prevented, and thus the decrease of the work efficiency is suppressed and intrusions into the intrusion prohibition region 60 can be surely prevented.

In addition, although it is likely that the operating area limiting control is not executed for an operator having high operational skill or a type of operator who performs operation carefully, it is likely that the operating area limiting control is repeatedly executed for an operator having low operation skill. In view of this, it is checked whether or not the operating area limiting control has been executed for an operator on the hydraulic excavator at Step S201 in FIG. 10 in the present embodiment. In a case where the operating area limiting control is executed while the operator is on the hydraulic excavator this time, the degree-of-proximity threshold is maintained at or altered to the initial value (dth1) (Steps S210, S211). The degree-of-proximity threshold is altered to dth2 in a case where other conditions (Steps S204, S205) are satisfied, only for an operator for whom the operating area limiting control has not been executed while the operator is on the hydraulic excavator this time. Thereby, intrusions into the intrusion prohibition region 60 can be surely prevented. Note that Step S201 in FIG. 10 can be omitted.

In addition, it is evaluated whether or not it is necessary to alter the degree-of-proximity threshold on the basis of the positional data of the nearest position relative to the intrusion prohibition region 60 obtained in the predetermined length of time tj in the present embodiment. Accordingly, the degree-of-proximity threshold is not altered at least in the predetermined length of time tj. Thereby, frequent alterations of the degree-of-proximity threshold can be prevented.

In addition, if the hydraulic excavator moves to another work location, it is likely that the position of the nearest position relative to the intrusion prohibition region 60 and contents of work to be executed by the hydraulic excavator are different from those before the movement, and there is a possibility that intrusions into the intrusion prohibition region 60 cannot be avoided if an operator performs work while having senses similar to those before the movement. In view of this, it is determined whether or not the travel operation lever 23 has been operated at Step S205 in FIG. 10 in the present embodiment. Thereby, in a case where the travel operation lever 23 has been operated, the degree-of-proximity threshold is maintained at/altered to the initial value (dth1). Thereby, intrusions into the intrusion prohibition region 60 can be surely prevented also when the hydraulic excavator has moved to another work location. Note that Step S205 in FIG. 10 can be omitted.

Note that although the degree-of-proximity threshold is switched depending on whether dispersion is larger or smaller than the dispersion threshold in the present embodiment, the degree-of-proximity threshold may be altered according to the magnitude of the dispersion. That is, in a case where the degree of proximity is a distance, the degree-of-proximity threshold (distance threshold) may be lowered as the dispersion decreases.

Second Embodiment

In the present embodiment, contents related to conditions under which the threshold altering section 109 resets the distance threshold (degree-of-proximity threshold) to the initial value (dth1) on the basis of data in the history storage section 106 are mentioned. In addition to the process illustrated in FIG. 10 explained in the first embodiment, the threshold altering section 109 executes a process illustrated in FIG. 13 explained in the present embodiment.

As data about whether or not operation of the hydraulic excavator 1 by an operator is enabled, the history storage section 106 acquires, from the main controller 57, operator-operation history data related to operation devices other than the operation levers 22 and 23. The operator-operation history data (operability data) acquired here includes positional data (ON position/OFF position/START position) about the key switch operated by the operator, positional data (lock position/unlock position) about the gate lock lever operated by the operator, and opened/closed state data (opened state/closed state) about the cab door on the upper swing structure 12 operated by the operator. The threshold altering section 109 resets the degree-of-proximity threshold to the initial value on the basis of the operator-operation history data acquired by the history storage section 106. In a case where the degree-of-proximity threshold has been set to dth2, the reset alters the degree-of-proximity threshold to the value (dth1) specifying proximity closer to the intrusion prohibition region.

Figure 13:
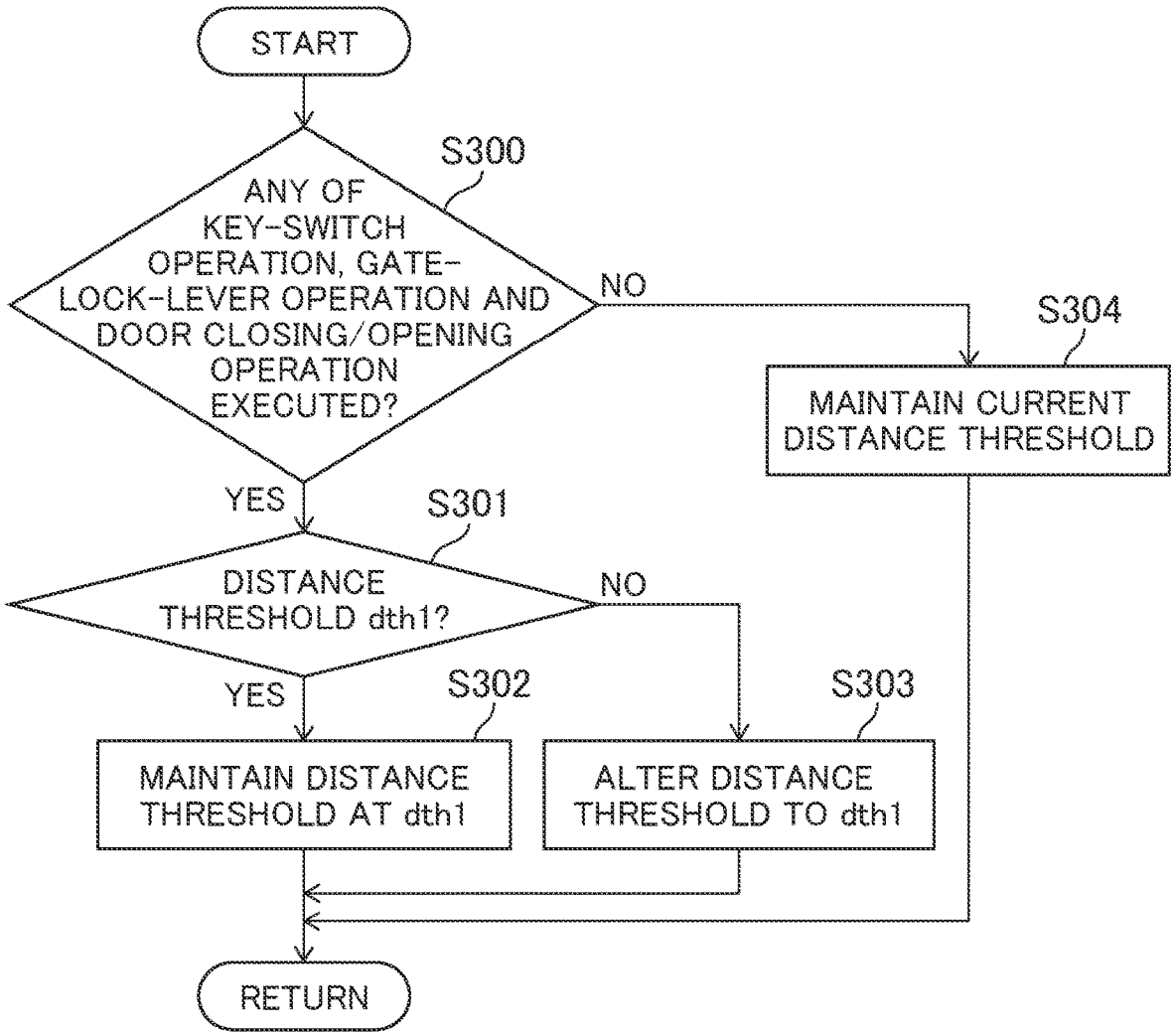
FIG. 13 is a figure illustrating a flowchart of the alteration of the distance threshold according to a second embodiment.

As illustrated in FIG. 13, at Step S300, the threshold altering section 109 determines whether or not the operator has executed any of key-switch-position switching operation (e.g. switching from the OFF position to the ON position), gate-lock-lever-position switching operation (switching from the lock position to the unlock position) and door opening/closing operation (operation of opening the closed door), on the basis of the data stored in the history storage section 106. In a case where it is determined that any of the operation has been executed, the process proceeds to Step S301.

At Step S301, it is determined whether or not the distance threshold used at the moment is dth1. In a case where the threshold is dth1, the process proceeds to Step S302, and the distance threshold is maintained at dth1. In a case where the threshold is not dth1, the process proceeds to Step S303, and the distance threshold is altered to dth1. In addition, in a case where it is determined at Step S300 that none of the operation has been performed, the process proceeds to Step S304, and the distance threshold used at the moment is maintained.

In a case where the operator has performed operation that satisfies the determination condition included in Step S300 mentioned before, it is considered that by temporarily disabling operation of the hydraulic excavator by the operator, the operator applies himself/herself to the suspension of the operation of the hydraulic actuators or to the operation other than the operation of the hydraulic actuator, and his/her attention is now paid to things other than the excavation work (e.g. setting a target surface, checking a terrain profile, taking a rest, and the like). It is considered that there is a possibility that the operator's awareness of the intrusion prohibition region 60 has lowered in operation of the hydraulic excavator after such a situation. In view of this, in the present embodiment, in a case where it is considered, on the basis of data stored in the history storage section 106, that operation of the hydraulic excavator by the operator is enabled again, the distance threshold is reset to dth1, which is the initial value. By setting the threshold to dht1, which is a larger threshold, in this manner, the control intervention is triggered earlier in a case where the excavator is in proximity to the intrusion prohibition region 60 in subsequent operation, and it is possible thereby to make the operator recognize the presence of the intrusion prohibition region 60.

Note that, on the basis of the operator's operability data, it may be determined at Step S300 whether operation of the hydraulic excavator by an operator has been enabled and/or disabled. For example, it may be determined whether or not at least one of operation of switching the key switch from the ON position to the OFF position, operation of switching the gate lock lever from the unlock position to the lock position, and operation of closing the opened door has been executed, that is, it may be determined whether or not operation of the hydraulic excavator by the operator has been disabled. In addition, although the degree-of-proximity threshold is reset to the initial value (dth1) in a case where it is determined that operation of the hydraulic excavator by the operator is temporarily disabled in the example described above, the degree-of-proximity threshold may be altered to a value other than the initial value as long as it is altered to a value specifying proximity closer to the intrusion prohibition region.

Third Embodiment

Figure 14:
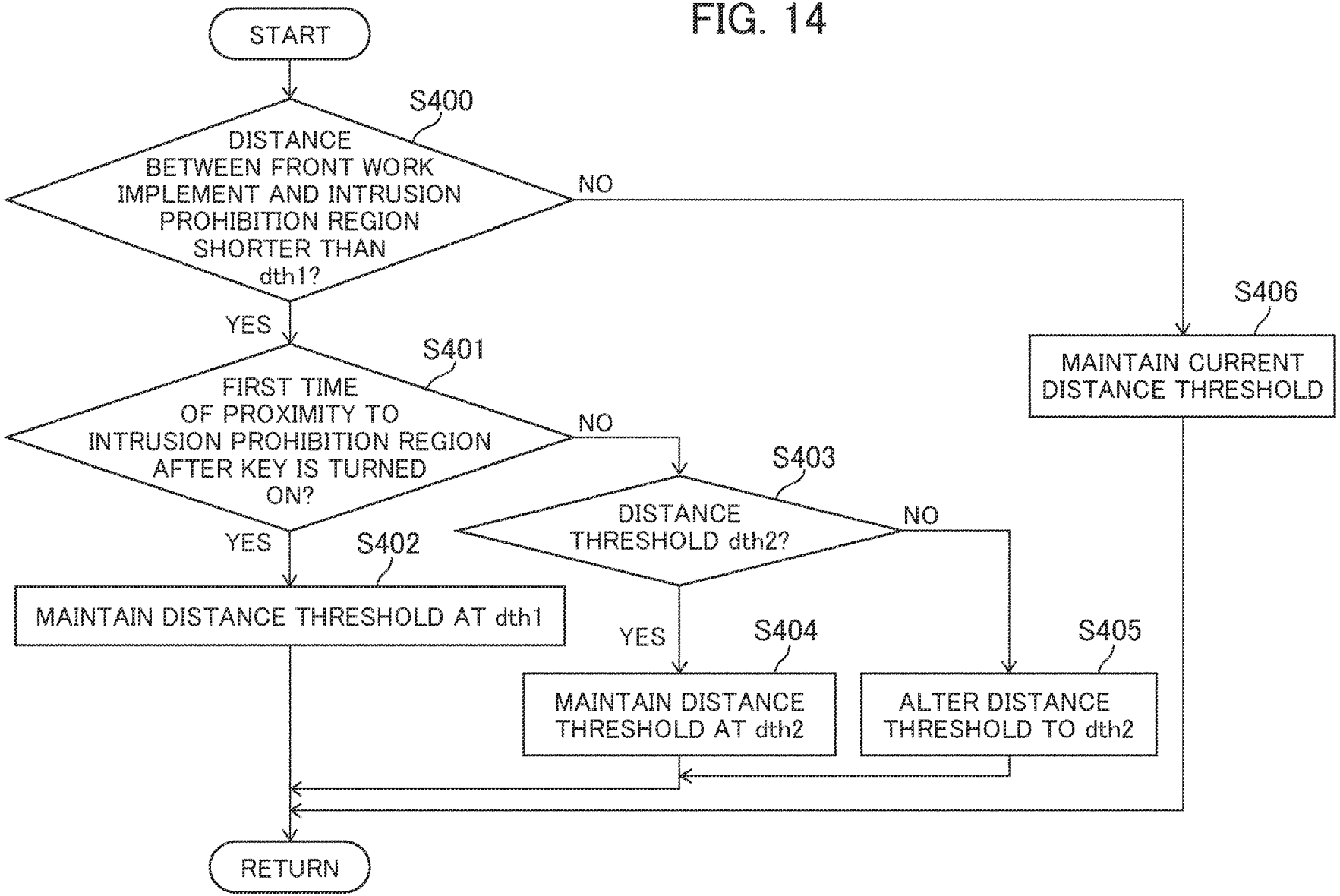
FIG. 14 is a figure illustrating a flowchart of the alteration of the distance threshold according to a third embodiment.

In the present embodiment, a method of alterations of the distance threshold by the threshold altering section 109 different from the flow illustrated in FIG. 10 is mentioned by using FIG. 14. A flow illustrated in FIG. 14 can be implemented in the same cycle as that in the flow in FIG. 9 or at intervals of the predetermined length of time tj illustrated in FIG. 10.

First, at Step S400, the threshold altering section 109 determines whether the distance between the nearest position on the front work implement 1A and the intrusion prohibition region 60 is shorter than dth1. Here, in a case where the distance is shorter than dth1, the process proceeds to Step S401, and in a case where the distance is equal to or longer than dth1, the process proceeds to Step S406.

At Step S401, the threshold altering section 109 determines whether it is the first proximity of the front work implement 1A to the intrusion prohibition region 60 (i.e. the distance between the nearest position and the intrusion prohibition region 60 is shorter than dth1) after the key switch has been switched to the ON position (i.e. after the key has been turned on). In a case where it is the first proximity of the front work implement 1A to the intrusion prohibition region 60, the process proceeds to Step S402, and in a case where it is the second or subsequent proximity of the front work implement 1A to the intrusion prohibition region 60, the process proceeds to Step S403.

At Step S402, the threshold altering section 109 maintains the distance threshold at dth1.

At Step S403, the threshold altering section 109 determines whether or not the distance threshold used at the moment is dth2. In a case where the threshold is dth2, the process proceeds to Step S404, and the distance threshold is maintained at dth2. In a case where the threshold is not dth2, the process proceeds to Step S405, and the distance threshold is altered to dth2.

At Step S406, the threshold altering section 109 maintains the distance threshold used at the moment.

In the present embodiment having the configuration described above, there is a possibility that an operator has not recognized the intrusion prohibition region 60 if it is the first proximity of the front work implement 1A to the intrusion prohibition region 60, and accordingly the control intervention is executed earlier, and the front work implement 1A can be stopped smoothly. Thereby, it is possible to make the operator recognizes the intrusion prohibition region 60. In addition, if it is the second or subsequent proximity of the front work implement 1A to the intrusion prohibition region 60, the control intervention is executed later on the assumption that the operator recognize the intrusion prohibition region, and thereby the reduction of the sense of discomfort and the enhancement of the work efficiency can be realized.

Note that although the distance threshold is altered to the value (dth2) corresponding to a shorter distance when the front work implement 1A is in proximity to the intrusion prohibition region 60 for the second time in the example described above, the distance threshold is altered to dth2 at any time at or after the second time when the front work implement 1A is in proximity to the intrusion prohibition region 60 in another possible configuration.

In addition, although the number of times that the front work implement 1A is in proximity to the intrusion prohibition region 60 is reset to zero when the key switch has been switched from the OFF position to the ON position in the example described above, the number of times can be reset to zero at any other timing in another possible configuration. The timing at which the number of times is reset to zero may be decided by the controller 40 or may be decided by an operator.

In addition, Step S205 in FIG. 10 may be added, and a process of resetting the number of times that the front work implement 1A is in proximity to the intrusion prohibition region 60 to zero, and additionally resetting the distance threshold to the initial value dth1 may be executed in a case where the travel lever 23 has been operated in the predetermined length of time tj.

<Others>

In any of the embodiments that have been explained thus far, data about alterations of the distance threshold is output on the display control section 77 in a case where the distance threshold has been altered, and a notification on that effect is given to an operator via the display device 55 in another possible configuration. In addition, the notification may not only be displayed, but may also be output as a sound.

In addition, although a configuration in which intrusions of the front work implement 1A into the intrusion prohibition region 60 set above the hydraulic excavator 1 are prevented is illustrated in the example described above, intrusions of the tip of the front work implement 1A into the intrusion prohibition region 60 set in a lateral direction from the hydraulic excavator 1 due to swings are prevented in another configuration that may be adopted. In that case, in order to take the influence of the inertia of the upper swing structure into consideration, the operating area limiting control may be executed by using, as the degree of proximity, not the distance of the front work implement 1A to the intrusion prohibition region 60, but a predicted length of time until contact.

Figure 16:
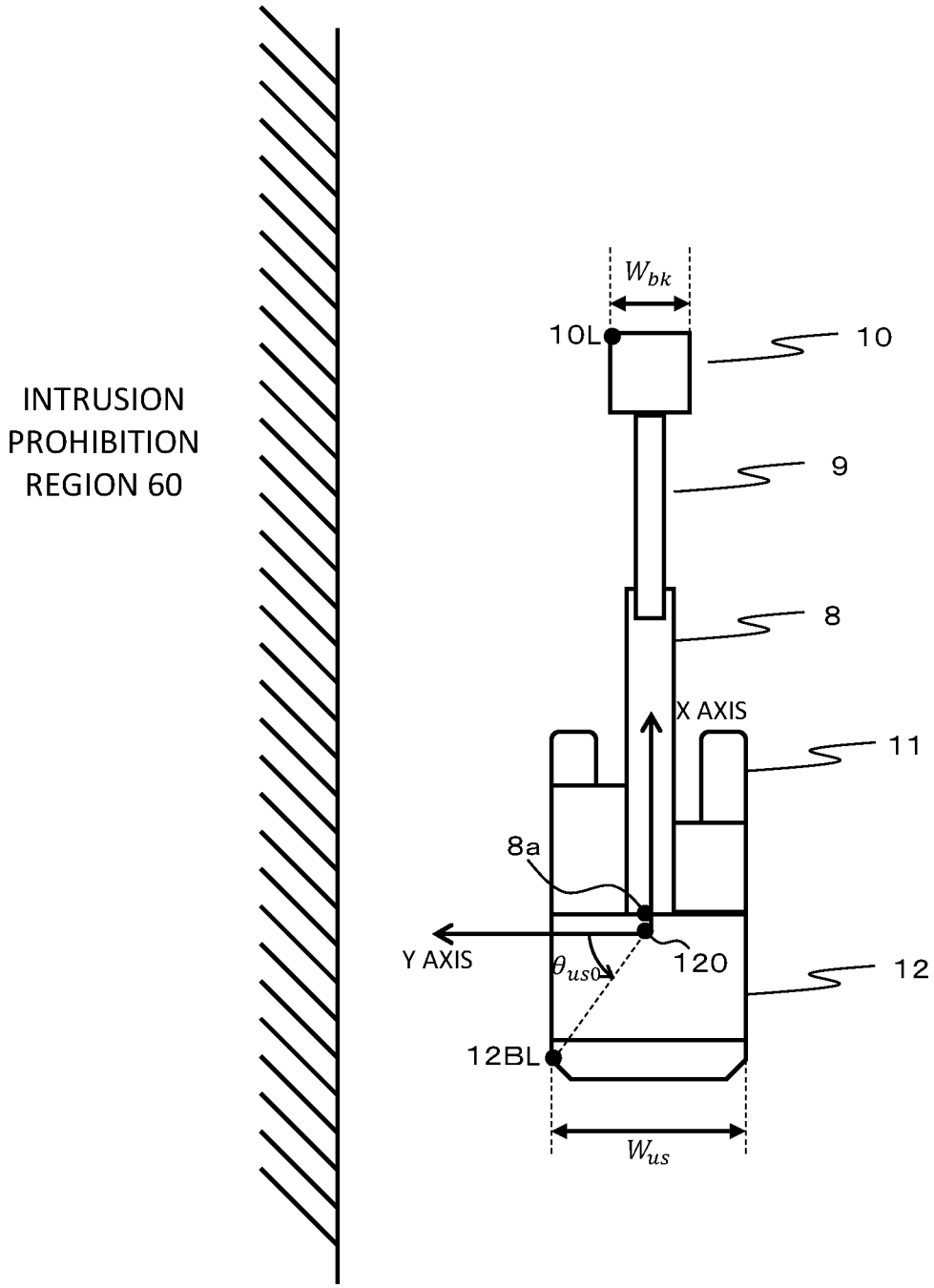
FIG. 16 is a figure illustrating a situation where an upper swing structure has not swung relative to the intrusion prohibition region.
Figure 17:
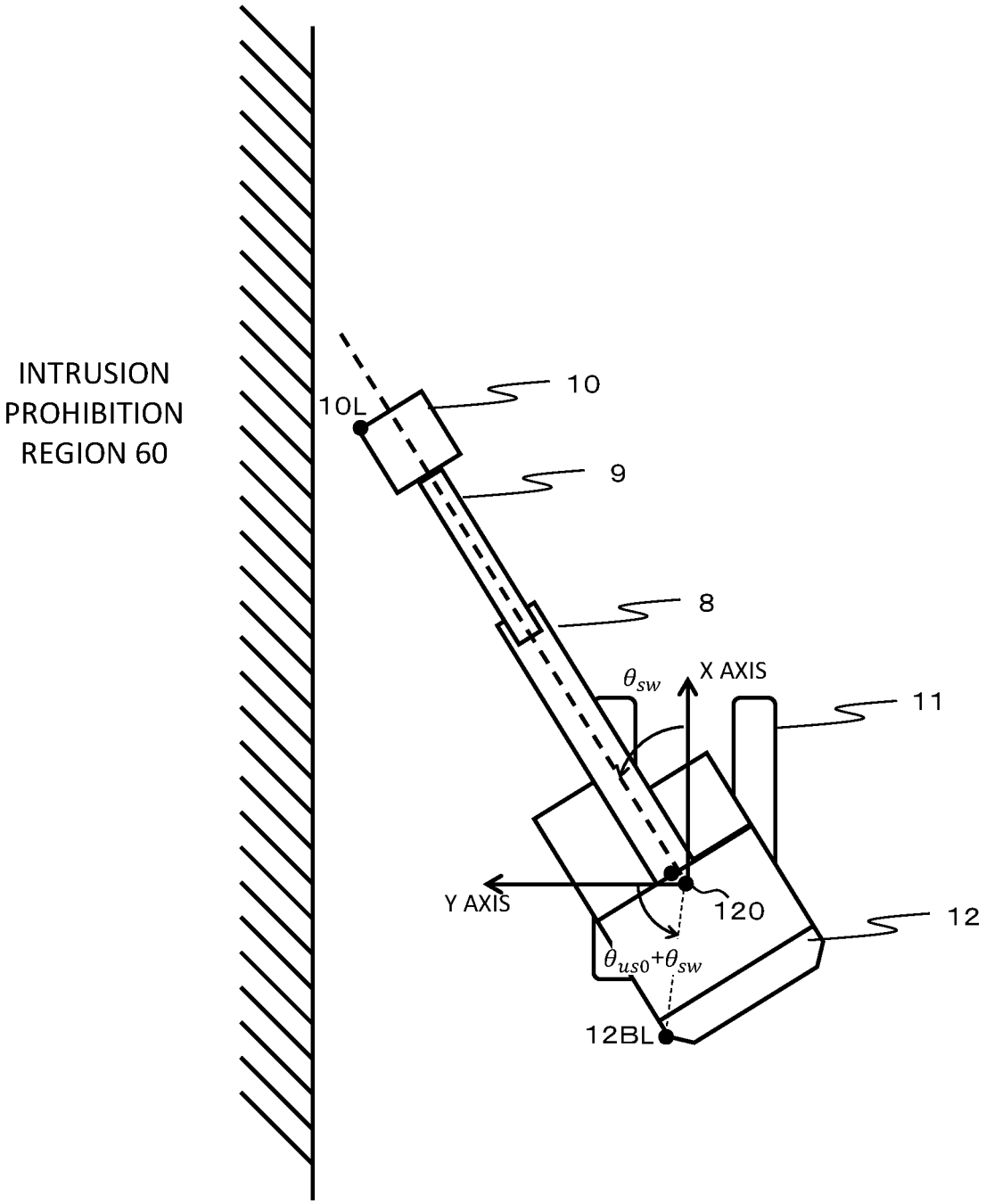
FIG. 17 is a figure illustrating a situation where the upper swing structure has swung by $\theta_{sw}$ after the situation illustrated in FIG. 16.

Here, a computation of the tip position on the front work implement 1A in a case where the intrusion prohibition region 60 is set in a lateral direction from the hydraulic excavator 1 is explained below by using FIG. 16 and FIG. 17. FIG. 16 illustrates a situation (reference situation) where the upper swing structure 12 has not swung relative to the intrusion prohibition region 60, and FIG. 17 illustrates a situation where the upper swing structure 12 has swung by $\theta_{sw}$ after the reference situation illustrated in FIG. 16.

At this time, if it is assumed that the widthwise dimension of the bucket 10 is $W_{bk}$, the position $Y_{bk}$ and velocity $V_{Ybk}$ of the left end 10L of the bucket 10 relative to the swing center 120 are expressed by the following formulae. It should be noted however that $\theta_{sw}$ having a dot thereon in the following formula indicates the angular velocity (time differential value) of $\theta_{sw}$.

$$Y_{bk}=[L_{bm}\cos\alpha+L_{am}\cos(\alpha+\beta)+L_{bk}\cos(\alpha+\beta+\gamma)+L_{sb}]\sin\theta_{sw}+W_{bk}\cos\theta_{sw}/2$$

$$V_{Ybk}=-[\omega_\alpha L_{bm}\sin\alpha+(\omega_\alpha+\omega_\beta)L_{am}\sin(\alpha+\beta)+(\omega_\alpha+\omega_\beta+\omega_\gamma)\sin(\alpha+\beta+\gamma)]\sin\theta_{sw}-\dot{\theta}sw[L_{bm}\cos\alpha+L_{am}\cos(\alpha+\beta)+L_{bk}\cos(\alpha+\beta+\gamma)+L_{sb}]\cos\theta_{sw}-\dot{\theta}_{sw}W_{bk}\sin\theta_{sw}/2 \quad \text{[Equation 8]}$$

In this manner, the position $Y_{bk}$ and velocity $V_{Ybk}$ can be computed also for the lateral direction of the excavator. Furthermore, the distance to the intrusion prohibition region 60 set in a lateral direction from the excavator, and the predicted length of time until contact with the intrusion prohibition region 60 can also be computed similarly to the case where the intrusion prohibition region 60 set above the excavator mentioned before (see FIG. 5 and FIG. 8).

Note that the illustrated computations of the positions and velocities of the bucket tip 10*b* and the arm rear end section 9*b* are merely examples, and portions of the hydraulic excavator 1 to be treated as control targets are not limited to the bucket tip 10*b* and the arm rear end section 9*b*. For example, in another configuration that may be adopted, intrusions of a rear end section (i.e. the work machine main body) of the upper swing structure 12 into the intrusion prohibition region 60 set in a lateral direction from the hydraulic excavator 1 due to swings are prevented. In that case, in order to take the influence of the inertia of the upper swing structure into consideration, not the distance of the upper swing structure relative to the intrusion prohibition region 60, but a predicted length of time until contact may be used as the degree of proximity to execute the operating area limiting control.

Here, a computation of the position of a left rear end section 12BL of the upper swing structure 12 in a case where the intrusion prohibition region 60 is set in a lateral direction from the hydraulic excavator 1 is explained below by using FIG. 16 and FIG. 17. If it is assumed that the widthwise dimension of the upper swing structure 12 is $W_{us}$, and the angle from the swing center 120 to the left rear end section 12BL of the upper swing structure 12 in the state illustrated in FIG. 16 is $\theta_{us0}$, the position $Y_{us}$ and velocity $V_{Yus}$ of the left rear end section 12BL of the upper swing structure 12 relative to the swing center 120 are expressed by the following formulae. It should be noted however that $\theta_{sw}$ having a dot thereon in the following formula indicates the angular velocity (time differential value) of $\theta_{sw}$.

$$Y_{us}=W_{us}\cos(\theta_{us0}+\theta_{sw})/2\cos\theta_{us0}$$

$$V_{Ybk}=-\dot{\theta}_{sw}W_{us}\sin(\theta_{us0}+\theta_{sw})/2\cos\theta_{us0} \quad \text{[Equation 9]}$$

In this manner, the position $Y_{us}$ and velocity $V_{Yus}$ can be computed also for the left rear end section 12BL of the upper swing structure 12. Furthermore, the distance to the intrusion prohibition region 60 set in a lateral direction from the excavator, and the predicted length of time until contact with the intrusion prohibition region 60 can also be computed similarly to the case about the intrusion prohibition region 60 set above the excavator mentioned before (see FIG. 5 and FIG. 8).

Note that the present invention is not limited to the embodiments described above, but includes various modification examples within the scope not deviating from the gist thereof. For example, the present invention is not limited to embodiments including all the configurations explained in the embodiments described above, but includes those from which some of the configurations are removed. In addition, some of the configurations according to an embodiment can be added to or replaced with configurations according to another embodiment.

In addition, configurations related to the controller described above (controller 40) or the functionalities, executed processes and the like of the configurations may partially or entirely be realized by hardware (e.g. by designing logics to execute the functionalities by an integrated circuit or by other means). In addition, the configurations related to the controller described above may be a program (software) by which the functionalities related to the configurations of the controller are realized by being read out and executed by a calculation processing device (e.g. a CPU). Data related to the program can be stored on a semiconductor memory (a flash memory, an SSD, or the like), a magnetic storage device (a hard disk drive, or the like), a recording medium (a magnetic disk, an optical disk, or the like) or the like, for example.

In addition, in the explanation of the embodiments described above, control lines and data lines that are understood to be necessary for the explanation of the embodiments are illustrated, but they are not necessarily illustrative of all the control lines and data lines related to a product. Actually, it may be considered that almost all the configurations are interconnected.

DESCRIPTION OF REFERENCE CHARACTERS

1A: Front work implement
1B: Machine Body
3: Travel motor (actuator)
4: Swing motor (actuator)
5: Boom cylinder (actuator)
6: Arm cylinder (actuator)
7: Bucket cylinder (actuator)
8: Boom
9: Arm
10: Bucket
30: Boom-angle sensor (posture sensor)
31: Arm-angle sensor (posture sensor)
32: Bucket-angle sensor (posture sensor)
33: Machine-Body-inclination-angle sensor (posture sensor)
40: Controller
60: Intrusion prohibition region
93: ROM (storage device)
94: RAM (storage device)
104: Degree-of-proximity calculating section
108: Control command section
106: History storage section
109: Threshold altering section

The invention claimed is:

1. A work machine comprising:

a work device installed on a machine main body;

a plurality of actuators that drive the machine main body and the work device;

a posture sensor that senses postural data about the machine main body and the work device; and a controller that computes a degree of proximity that is an index value indicating proximity between a preset intrusion prohibition region, and the work device and the machine main body on a basis of positional data about the intrusion prohibition region and the postural data, and when the proximity specified by the degree of proximity is closer than proximity specified by a degree-of-proximity threshold set as a threshold for the degree of proximity, executes operating area limiting control to decelerate at least one of the plurality of actuators such that an intrusion of the work device and the machine main body into the intrusion prohibition region is prevented, the work machine further comprising a storage device that stores history data about the degree of proximity computed by the controller, the controller altering the degree-of-proximity threshold on a basis of the history data about the degree of proximity stored in the storage device, the degree of proximity being a distance between the work device and the machine main body, and the intrusion prohibition region, the controller executing the operating area limiting control when the distance is shorter than the degree-of-proximity threshold, and lowers the degree-of-proximity threshold as dispersion of the distance decreases.

2. The work machine according to claim 1, wherein the storage device stores operability data indicating whether or not operation of the work machine by an operator is enabled, and when it is checked on a basis of the operability data that operation of the work machine by the operator is temporarily disabled, the controller alters the degree-of-proximity threshold to a value specifying proximity closer to the intrusion prohibition region.

3. The work machine according to claim 1, wherein the storage device stores the number of times the degree of proximity to the intrusion prohibition region has become higher than the degree-of-proximity threshold, and when the number of times has reached a predetermined number of times, the controller alters the degree-of-proximity threshold to a value specifying proximity closer to the intrusion prohibition region.

* * * * *